US010369794B2

(12) United States Patent
Mizuno

(10) Patent No.: US 10,369,794 B2
(45) Date of Patent: Aug. 6, 2019

(54) PRINT DEVICE AND NON-TRANSITORY COMPUTER-READABLE MEDIUM

(71) Applicant: BROTHER KOGYO KABUSHIKI KAISHA, Nagoya (JP)

(72) Inventor: Naoki Mizuno, Takahama (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 49 days.

(21) Appl. No.: 15/717,101

(22) Filed: Sep. 27, 2017

(65) Prior Publication Data

US 2018/0281415 A1 Oct. 4, 2018

(30) Foreign Application Priority Data

Mar. 30, 2017 (JP) ..... 2017-066946

(51) Int. Cl.
*B41J 2/165* (2006.01)
*B41J 2/045* (2006.01)

(52) U.S. Cl.
CPC ..... *B41J 2/16505* (2013.01); *B41J 2/04563* (2013.01); *B41J 2/04586* (2013.01); *B41J 2/16508* (2013.01); *B41J 2/16523* (2013.01); *B41J 2/16535* (2013.01); *B41J 2/16552* (2013.01)

(58) Field of Classification Search
CPC ..... B41J 2/16505; B41J 2/16523; B41J 2/16508; B41J 2/16552; B41J 2/04563; B41J 2/04586; B41J 2/16535
See application file for complete search history.

(56) References Cited

U.S. PATENT DOCUMENTS

2009/0244172 A1* 10/2009 Snyder ..... B41J 2/16526 347/33
2012/0299993 A1* 11/2012 Steuer ..... B41J 2/16505 347/28
2018/0126737 A1* 5/2018 Asano ..... B41J 2/16535

FOREIGN PATENT DOCUMENTS

JP H11309868 A 11/1999
JP 2000062213 A 2/2000
JP 2008238561 A 10/2008

* cited by examiner

*Primary Examiner* — Scott A Richmond
(74) *Attorney, Agent, or Firm* — K&L Gates LLP

(57) ABSTRACT

As first determination processing, a CPU of a printer determines whether a temperature T, which is based on an input value from a temperature detector, is higher than a reference temperature Tw. In a case where the CPU has not determined, in the first determination processing, that the temperature T is higher than the reference temperature Tw, the CPU, after cover processing and without performing soak processing, performs first cap processing, which puts a nozzle face into a state in which it is not soaked by a cleaning liquid. In a case where the CPU has determined, in the first determination processing, that the temperature T is higher than the reference temperature Tw, the CPU, after the cover processing, performs the soak processing, which supplies the cleaning liquid to a cap, thus putting the nozzle face into a state in which it is soaked by the cleaning liquid. The possibility that a discharge failure will occur in a nozzle of the printer is therefore reduced.

11 Claims, 13 Drawing Sheets

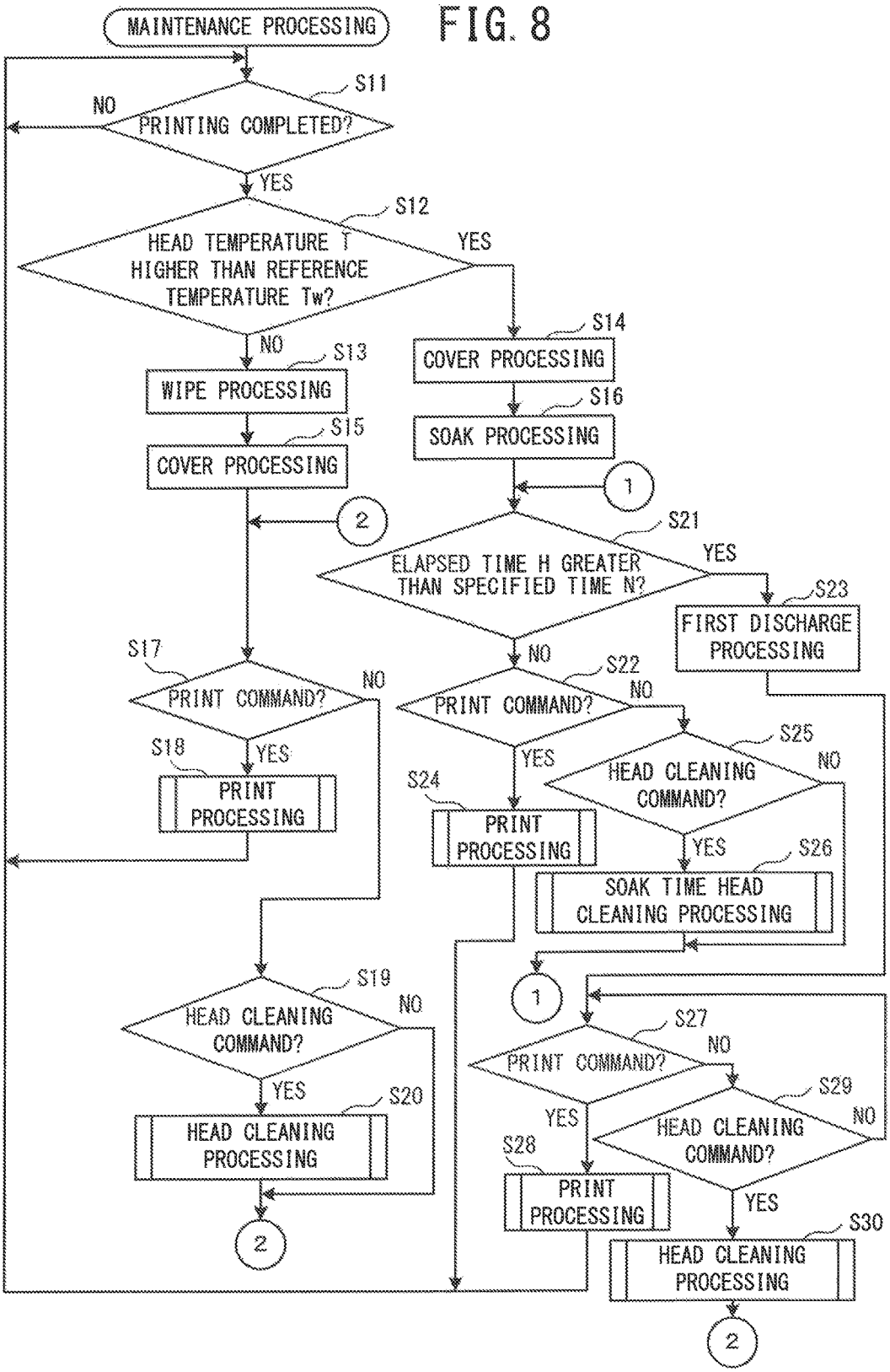
FIG. 8
MAINTENANCE PROCESSING
S11
PRINTING COMPLETED?
NO
YES
S12
HEAD TEMPERATURE T HIGHER THAN REFERENCE TEMPERATURE Tw?
YES
NO
S13
WIPE PROCESSING
S15
COVER PROCESSING
S14
COVER PROCESSING
S16
SOAK PROCESSING
1
2
S21
ELAPSED TIME H GREATER THAN SPECIFIED TIME N?
YES
NO
S23
FIRST DISCHARGE PROCESSING
S17
PRINT COMMAND?
NO
YES
S18
PRINT PROCESSING
S22
PRINT COMMAND?
NO
YES
S24
PRINT PROCESSING
S25
HEAD CLEANING COMMAND?
NO
YES
S26
SOAK TIME HEAD CLEANING PROCESSING
S19
HEAD CLEANING COMMAND?
NO
YES
S20
HEAD CLEANING PROCESSING
2
1
S27
PRINT COMMAND?
NO
YES
S28
PRINT PROCESSING
S29
HEAD CLEANING COMMAND?
NO
YES
S30
HEAD CLEANING PROCESSING
2

PRINT DEVICE AND NON-TRANSITORY COMPUTER-READABLE MEDIUM

CROSS-REFERENCE TO RELATED APPLICATION

This application claims priority to Japanese Patent Application No. 2017-66946 filed on Mar. 30, 2017, the disclosure of which is herein incorporated by reference in its entirety.

BACKGROUND

The present disclosure relates to a print device that is provided with a cap that is able to cover a nozzle and to a non-transitory computer-readable medium.

An inkjet type of print device is known that is provided, in a non-printing area, with a cap unit that prevents a nozzle from drying out while the print device is idle. The cap unit is configured from a rectangular cap case whose top face is open and from a cap member that is formed as a single unit with the interior of the cap case and is formed into a cup shape by an elastic member. In the print device, a carriage on which a print head is mounted moves to the non-printing area when printing is completed, and the cap member covers a nozzle of the print head.

SUMMARY

In the print device, the temperature of the print head increases, because an integrated drive circuit that drives the print head during printing generates heat. If the cap member covers the nozzle of the print head when the temperature of the print head has increased, the interior of the cap member dries out, and liquid inside the nozzle dries out. Therefore, the viscosity of the ink inside the nozzle increases, creating the possibility that a discharge failure will occur in the nozzle the next time that printing is performed.

Embodiments of the broad principles derived herein provide a print device and a non-transitory computer-readable medium that decrease the possibility that a discharge failure will occur in the nozzle.

The embodiments herein provide a print device that includes a head provided with a nozzle face having a nozzle, a cap configured to contact the nozzle face and covering the nozzle, a supply flow path connected to the cap and configured to supply a cleaning liquid to the interior of the cap, a waste liquid flow path connected to the cap and configured to drain off the cleaning liquid that has been supplied to the interior of the cap, a temperature detector configured to detect the temperature of the head, a processor, and a memory. The memory stores computer-readable instructions that, when executed by the processor, perform processes including cover processing, first determination processing, first cap processing, and second cap processing. The cover processing puts the cap into a covering state in which the cap covers the nozzle. The first determination processing determines, based on an input value from the temperature detector, whether the temperature is higher than a reference temperature. When the first determination processing has not determined that the temperature is higher than the reference temperature, the first cap processing, after the cover processing, puts the nozzle face into a state in which the nozzle face is not soaked by the cleaning liquid. When the first determination processing has determined that the temperature is higher than the reference temperature, the second cap processing, after the cover processing, supplies the cleaning liquid from the supply flow path to the cap, thus putting the nozzle face into a soak state in which the nozzle face is soaked by the cleaning liquid.

The embodiments herein also provide a non-transitory computer readable medium storing computer readable instructions, that are executed by a processor of a print device. The print device is provided with a head provided with a nozzle face having a nozzle, a cap configured to contact the nozzle face and covering the nozzle, a supply flow path connected to the cap and configured to supply a cleaning liquid to the interior of the cap, a waste liquid flow path connected to the cap and configured to drain off the cleaning liquid that has been supplied to the interior of the cap, and a temperature detector configured to detect the temperature of the head. The processor is configured to control the print device, and the computer-readable instructions, when executed by the processor, perform processes including cover processing, first determination processing, first cap processing, and second cap processing. The cover processing puts the cap into a covering state in which the cap covers the nozzle. The first determination processing determines, based on an input value from the temperature detector, whether the temperature is higher than a reference temperature. When the first determination processing has not determined that the temperature is higher than the reference temperature, the first cap processing, after the cover processing, puts the nozzle face into a state in which the nozzle face is not soaked by the cleaning liquid. When the first determination processing has determined that the temperature is higher than the reference temperature, the second cap processing, after the cover processing, supplies the cleaning liquid from the supply flow path to the cap, thus putting the nozzle face into a soak state in which the nozzle face is soaked by the cleaning liquid.

BRIEF DESCRIPTION OF THE DRAWINGS

Embodiments will be described below in detail with reference to the accompanying drawings in which:

FIG. 8 is a flowchart of maintenance processing;

DETAILED DESCRIPTION

Figure 1:
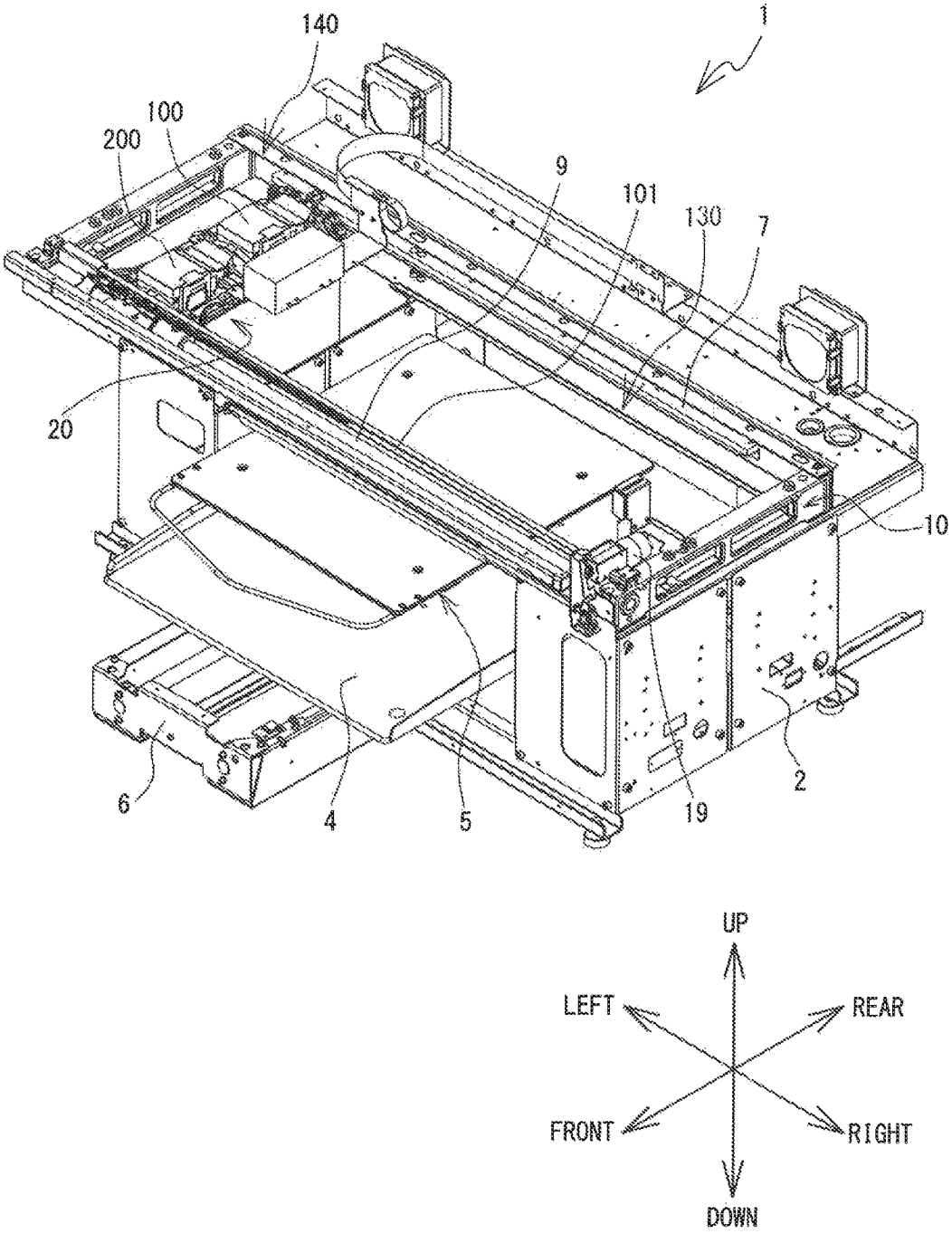
FIG. 1 is an oblique view of a printer.

A configuration of a printer 1 will be explained with reference to FIGS. 1 to 7. The top side, the bottom side, the lower left side, the upper right side, the lower right side, and the upper left side in FIG. 1 respectively correspond to the top side, the bottom side, the front side, the rear side, the right side, and the left side of the printer 1.

Mechanical Configuration of the Printer 1

The printer 1 is an inkjet printer that performs printing by discharging liquid inks 91 (refer to FIG. 7) from nozzles 112 onto a printing medium such as a cloth such as a T-shirt or the like (not shown in the drawings), a paper, or the like. The printer 1 prints a color image on the printing medium by discharging downward five different types of the inks 91 (white (W), black (K), yellow (Y), cyan (C), and magenta (M)), for example. In the explanation that follows, among the five different types of the inks 91, the white ink 91 will be called the white ink, and the other four types of the inks 91, black, cyan, yellow, and magenta, will be collectively called the color inks. The white ink is an ink that is more prone to sedimentation than are the color inks. The white ink is also more prone to discharge failures than are the color inks, due to clogging in the nozzles 112.

As shown in FIG. 1, the printer 1 is provided with a housing 2, a platen drive mechanism 6, a pair of guide rails (not shown in the drawings), a platen 5, a tray 4, a frame body 10, a guide shaft 9, a rail 7, a carriage 20, head units 100, 200, a drive belt 101, and a drive motor 19.

An operation portion (not shown in the drawings) that performs operations of the printer 1 is provided in a position on the right front side of the housing 2. The operation portion is provided with a display 49 (refer to FIG. 6) and operation buttons 501 (refer to FIG. 6). An operator operates the operation buttons 501 when inputting commands that pertain to various operations of the printer 1. A power off command that turns off a power supply 56 (refer to FIG. 6) and the power on command that turns on the power supply 56 are also input by specific operations of the operation buttons 501. Pressing and holding the operation buttons 501 is one example of a specific operation.

The frame body 10 has a frame shape that is rectangular in a plan view, and it is installed in the top portion of the housing 2. The frame body 10 supports the guide shaft 9 on its front side and supports the rail 7 on its rear side. The guide shaft 9 extends from left to right on the inner side of the frame body 10. The rail 7 is disposed opposite the guide shaft 9 and extends from left to right.

Figure 2:
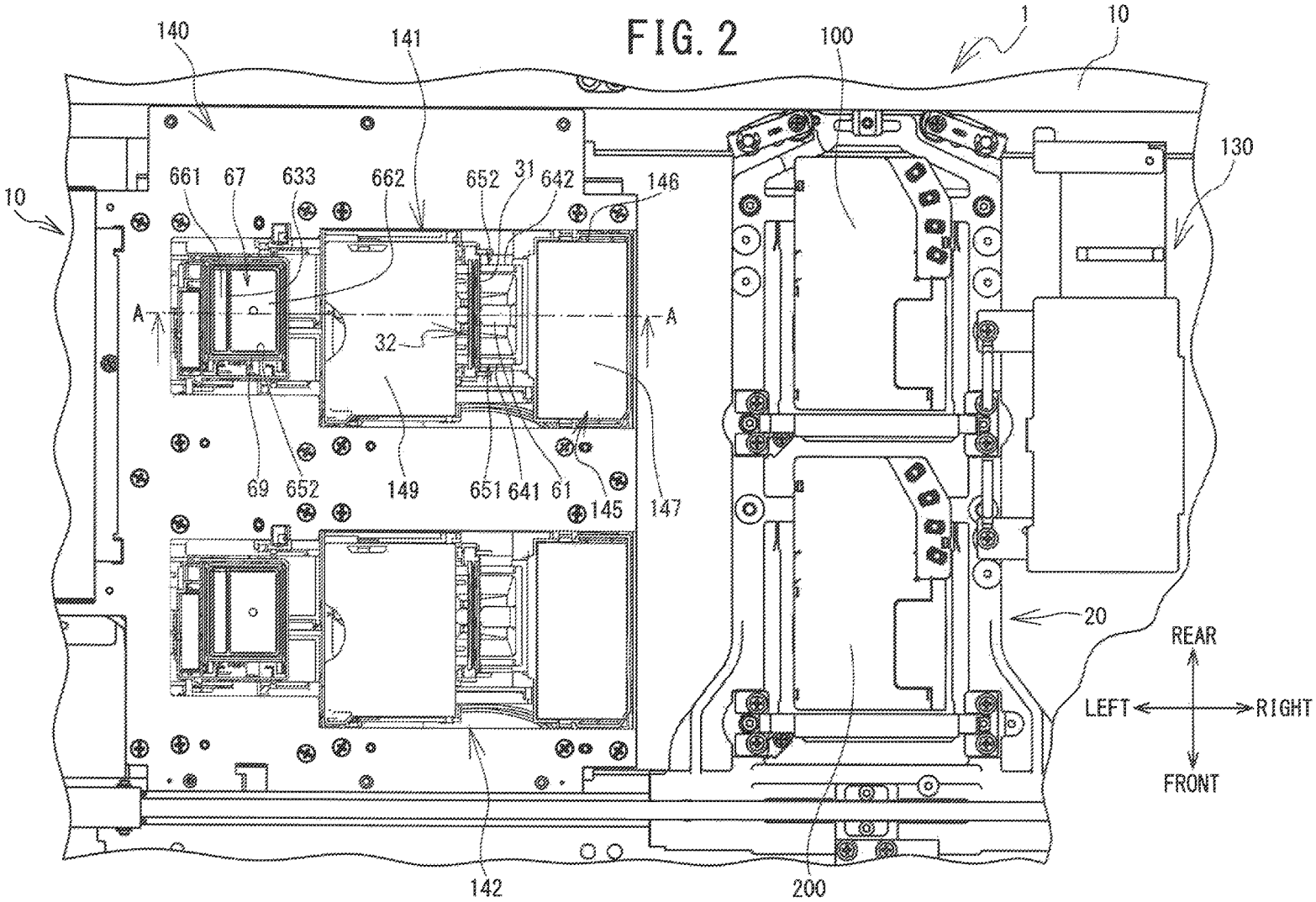
FIG. 2 is a plan view of the printer.
Figure 3:
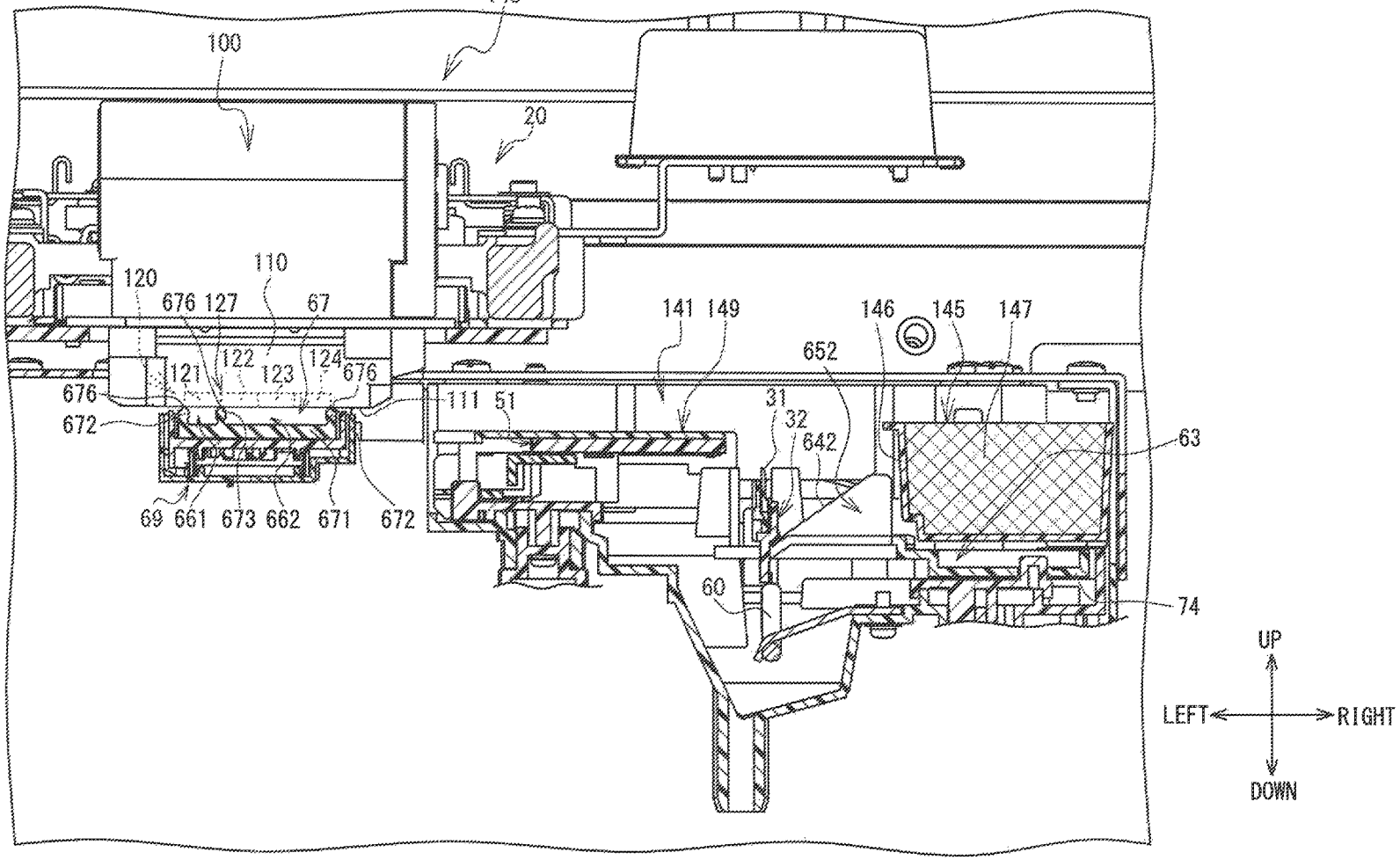
FIG. 3 is a section view along the line A-A in FIG. 2, in which a wiper is in a wiper withdrawn position and a cap 67 is in a covering position.

The carriage 20 is supported such that it can be conveyed to the left and the right along the guide shaft 9. As shown in FIGS. 1 and 2, the head units 100, 200 are carried on the carriage 20 and are arrayed in the front-rear direction. The head unit 100 is disposed to the rear of the head unit 200. As shown in FIG. 3, the bottom portions of the head units 100, 200 are each provided with a head 110. The head 110 of the head unit 100 discharges the white ink. The head 110 of the head unit 200 discharges the color inks.

Each of the heads 110 is provided with a nozzle face 111, which is a face that has a plurality of the tiny nozzles 112 (refer to FIG. 7) that are capable of discharging the inks 91 downward. The nozzle faces 111 are flat surfaces that extend in the left-right direction and the front-rear direction, and they form the bottom faces of the head units 100, 200. The plurality of the nozzles 112 in the nozzle face 111 are provided in a nozzle disposition area 120. The nozzle disposition area 120 is provided in the central portion of the left-right direction of the nozzle face 111 and extends in the front-rear direction.

The nozzle face 111 has nozzle arrays 121 to 124. Each one of the nozzle arrays 121 to 124 is an array of a plurality of the nozzles 112. The nozzle arrays 121 to 124 are disposed in four separate areas in the left-right direction of the nozzle disposition area 120. The nozzle arrays 121 to 124 are arrayed as the nozzle array 121, the nozzle array 122, the nozzle array 123, and the nozzle array 124, in that order from left to right.

The nozzle arrays 121 to 124 of the head unit 100 are nozzle arrays that are capable of discharging the white ink. Each one of the nozzle arrays 121 to 124 of the head unit 200 is capable of discharging a different one of the color inks. For example, the nozzle array 121 is capable of discharging the black ink, the nozzle array 122 is capable of discharging the yellow ink, the nozzle array 123 is capable of discharging the cyan ink, and the nozzle array 124 is capable of discharging the magenta ink.

As shown in FIG. 1, the drive belt 101 spans the inner side of the frame body 10 in the left-right direction. The drive motor 19 is coupled to the carriage 20 through the drive belt 101. The carriage 20 is moved reciprocally to the left and the right along the guide shaft 9 by the driving of the drive belt 101 by the drive motor 19.

The platen drive mechanism 6 is provided with the pair of the guide rails (not shown in the drawings) and a platen support base (not shown in the drawings). The pair of the guide rails extend from the front to the rear on the inner side of the platen drive mechanism 6 and support the platen support base such that it can move toward the front and the rear. The top portion of the platen support base supports the platen 5. The platen 5 supports the printing medium.

The tray 4 is provided below the platen 5. When the operator places a T-shirt or the like on the platen 5, the tray 4 receives the sleeves and the like of the T-shirt, thus protecting the sleeves and the like, such that they do not come into contact with other parts in the interior of the housing 2.

The platen drive mechanism 6 is driven by an auxiliary scanning direction drive portion 46 that will be described later (refer to FIG. 6). When the platen drive mechanism 6 is thus driven, it moves the platen support base and the platen 5 toward the front and the rear along the pair of the guide rails. As the platen 5 conveys the printing medium in the front-rear direction (an auxiliary scanning direction), the inks 91 are discharged from the heads 110 as they move reciprocally in the left-right direction (a main scanning direction). The printer 1 thus performs printing on the printing medium.

Along the path that the heads 110 travel, the area where the heads 110 perform printing will be called the printing area 130, as shown in FIGS. 1 and 2. The area along the path that the heads 110 travel that is outside the printing area 130 will be called the non-printing area 140. The non-printing area 140 is an area in the left portion of the printer 1, for example. The printing area 130 is the area from the right edge of the non-printing area 140 to the right end of the printer 1. The platen 5 and the tray 4 are provided in the printing area 130.

Various types of maintenance operations for ensuring printing quality are performed in the non-printing area 140. For example, the maintenance operations include flushing, ink suction that is called a purge, soak cleaning, wipe processing that performs a nozzle face wiping operation, a wiper wiping operation, and the like. Flushing is an operation that, before printing is performed on the printing medium, discharges the inks 91 from the nozzles 112 onto a flushing receiving portion 145 that will be described later (refer to FIG. 2). The performing of flushing causes the inks 91 to be discharged appropriately from the nozzles 112 immediately after the printing starts. Ink suction is an operation (refer to FIG. 12) in which, in a state in which the areas around the nozzle faces 111 are covered by caps 67 that will be described later (refer to FIG. 2), the inks 91 are pulled out of the nozzles 112 by a suction pump 708 that will be described later. The performing of ink suction discharges, along with the inks 91, any air bubbles that have gotten inside the nozzles 112, for example. It is therefore possible to decrease the possibility that the air bubbles will cause a discharge failure to occur. Soak cleaning is an operation that uses a cleaning liquid 92 to clean the nozzle faces 111 to which the inks 91 have adhered (refer to FIG. 12). Note that the inks 91 have a greater viscosity than does the cleaning liquid 92.

The wipe processing performs the nozzle face wiping operation, in which wipers 31 that will be described later wipe off the excess inks 91 and the excess cleaning liquid 92 that are remaining on the surfaces of the nozzle faces 111 (refer to FIG. 4). When the inks 91 that are remaining on the nozzle faces 111 harden and bind to the nozzle faces 111, for example, there is a possibility that it will become difficult for the inks 91 to be discharged from the nozzle faces 111. That possibility can be decreased by the performing of the nozzle face wiping operation. When the inks 91 and the cleaning liquid 92 that are remaining on the nozzle faces 111 make their way into the nozzles 112, for example, there is a possibility that meniscuses that are formed in the nozzles 112 will be affected. That possibility can also be decreased by the performing of the nozzle face wiping operation. The wiper wiping operation is an operation in which absorption members 51 that will be described later wipe off the inks 91 that are adhering to the wipers 31 (refer to FIG. 5). Even if the inks 91 and the cleaning liquid 92 that have been wiped off of the nozzle faces 111 are adhering to the wipers 31, the performing of the wiper wiping operation is able to decrease the possibility that the inks 91 and the cleaning liquid 92 from the wipers 31 will adhere to the nozzle faces 111 the next time that the nozzle face wiping operation is performed.

As shown in FIG. 2, the non-printing area 140 is provided with maintenance portions 141, 142. The maintenance portions 141, 142 are positioned below the travel paths of the head units 100, 200, respectively. Maintenance processing for the head units 100, 200 is performed in the maintenance portions 141, 142 under the control of a CPU (central processing unit) 40 (refer to FIG. 6) of the printer 1. The configurations and operations of the maintenance portions 141, 142 are the same. Accordingly, in the explanation that follows, the maintenance portion 141 will be explained.

As shown in FIGS. 2 and 3, the maintenance portion 141 is provided with the wiper 31, the flushing receiving portion 145, the absorption member 51, a support plate 149, the cap 67, and a cap support portion 69. As shown in FIG. 3, the flushing receiving portion 145 is positioned in the right part of the maintenance portion 141 and above a wall portion 74 of a moving portion 63 that will be described later. The flushing receiving portion 145 is provided with a container portion 146 and an absorbent member 147. The container portion 146 is a container that is rectangular in a plan view and is open at the top. The absorbent member 147 is disposed inside the container portion 146 and is a three-dimensional rectangular member that is able to absorb the ink 91. The flushing receiving portion 145 receives the ink 91 that has been discharged from the head unit 100 by the flushing operation. The ink 91 is absorbed by the absorbent member 147.

As shown in FIGS. 2 and 3, the wiper 31 is disposed to the left of the flushing receiving portion 145. The wiper 31 is able to move up and down. As shown in FIG. 3, the wiper 31 is provided below the nozzle face 111. The wiper 31 extends in the front-rear direction. The top edge of the wiper 31 is parallel to the nozzle face 111. A wiper support portion 32 is disposed on the bottom side of the wiper 31 and supports the wiper 31. The wiper support portion 32 has a rectangular shape, with its long axis extending in the front-rear direction, and it has a specified width in the left-right direction. The bottom portion of the wiper support portion 32 is able to move in relation to inclined portions 641, 642 (described later), which are provided on the moving portion 63, and comes into contact with the inclined portions 641, 642. The wiper support portion 32 is energized downward by a coil spring 60 that is affixed to the bottom portion of the wiper support portion 32.

As shown in FIGS. 2 and 3, the moving portion 63 is provided with opposing wall portions 651, 652 and the wall portion 74 (refer to FIG. 3). The pair of the opposing wall portions 651, 652 face one another in the front-rear direction and are substantially triangular in a side view. The opposing wall portions 651, 652 are respectively provided with the inclined portions 641, 642.

The pair of the inclined portions 641, 642 face one another in the front-rear direction. The pair of the inclined portions 641, 642 are formed on the upper parts of the opposing wall portions 651, 652, respectively, and are components that extend obliquely downward toward the left. As shown in FIG. 3, the wall portion 74 is a wall portion that is rectangular in a plan view, and it is connected to the lower parts of the right edges of the opposing wall portions 651, 652, respectively. The wall portion 74 is connected to a second drive portion 195 that will be described later (refer to FIG. 6). The moving portion 63 is moved to the left and the right by the second drive portion 195. The wiper support portion 32 moves up and down along the inclined portions 641, 642 in conjunction with the movements of the moving portion 63 to the right and the left, respectively.

An up-down position of the wiper 31 and the wiper support portion 32 in which the wiper 31 is separated from the nozzle face 111 and the absorption member 51, as shown in FIG. 3, will be called the wiper withdrawn position. In the wiper withdrawn position, the wiper support portion 32 is in contact with the lower ends of the inclined portions 641, 642.

Figure 4:
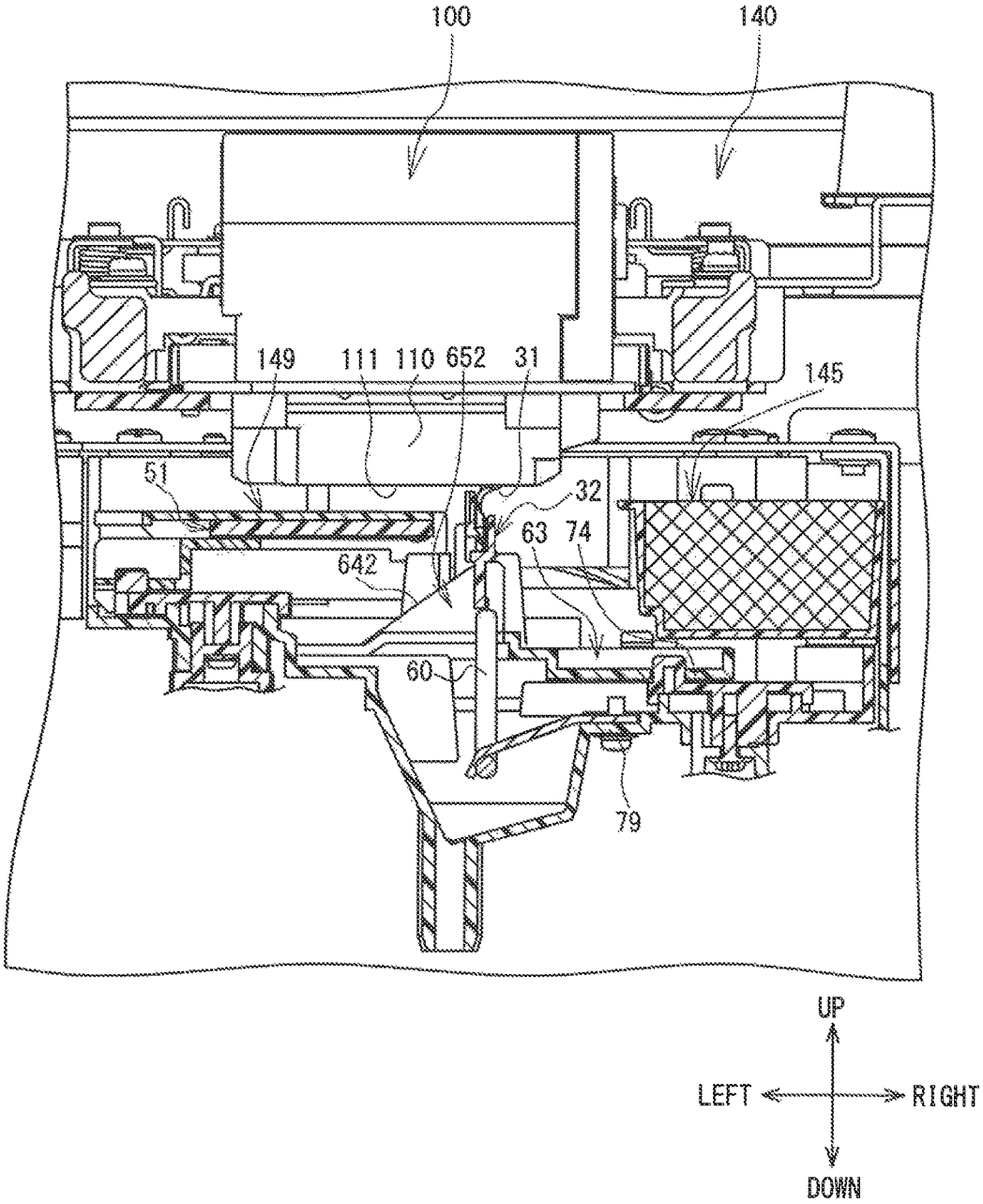
FIG. 4 is a section view that shows a state in which the wiper is in a first contact position and a nozzle face wiping operation is being performed.

An up-down position of the wiper 31 and the wiper support portion 32 in which the wiper 31 can be in contact with the nozzle face 111, as shown in FIG. 4, will be called the first contact position. In the first contact position, the wiper support portion 32 is in contact with the upper ends of the inclined portions 641, 642. In a state in which the wiper 31 and the wiper support portion 32 are in the first contact position, the moving of the carriage 20 to the right causes the wiper 31 to slide along the nozzle face 111, removing the ink 91 and the cleaning liquid 92 from the nozzle face 111. In other words, the nozzle face wiping operation is performed.

Figure 5:
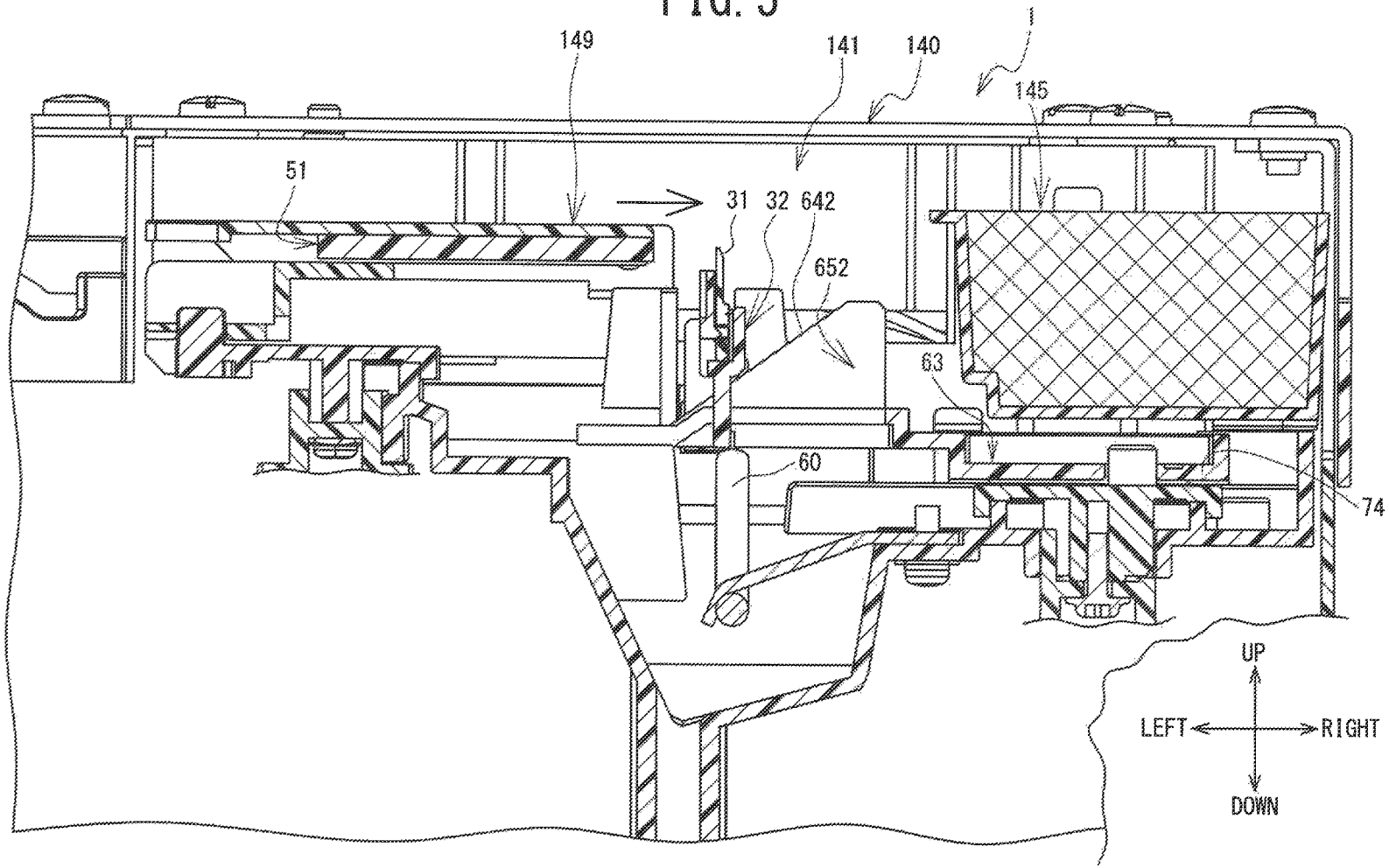
FIG. 5 is a section view that shows a state in which the wiper is in a second contact position.

An up-down position of the wiper 31 and the wiper support portion 32 in which the wiper 31 can be in contact with the absorption member 51, as shown in FIG. 5, will be called the second contact position. In the second contact position, the wiper support portion 32 is in contact with the inclined portions 641, 642 slightly below their centers in the up-down direction.

The support plate 149 is provided between the wiper 31 and the cap 67 in the left-right direction. The support plate 149 is a plate-shaped member that is rectangular in a plan view, with its axes extending in the front-rear direction and the left-right direction. As shown in FIG. 3, the absorption member 51 is affixed to the bottom face of the support plate 149 and is supported by the support plate 149. The absorption member 51 is plate-shaped, with its axes extending in the front-rear direction and the left-right direction. The absorption member 51 is able to absorb the ink 91 and the cleaning liquid 92.

Figure 6:
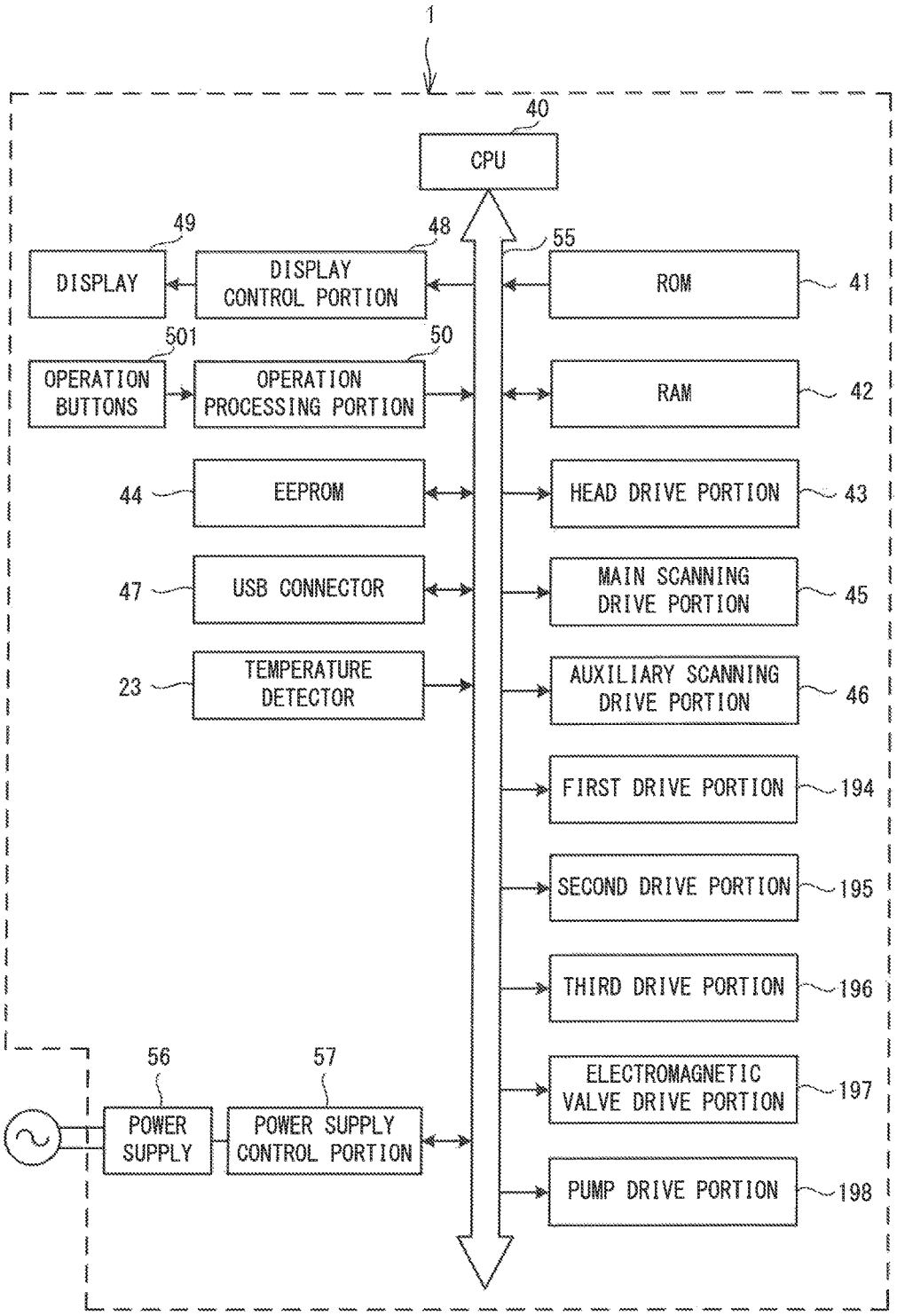
FIG. 6 is a block diagram that shows an electrical configuration of the printer.

The support plate 149 is moved to the left and the right by a first drive portion 194 (refer to FIG. 6). In a state in which the wiper 31 and the wiper support portion 32 are in the second contact position, the moving of the support plate 149 to the right causes the wiper 31 to slide along the bottom face of the absorption member 51. In that case, the absorption member 51 absorbs and removes the ink 91 and the cleaning liquid 92 that have adhered to the wiper 31. In other words, the wiper wiping operation is performed.

As shown in FIGS. 2 and 3, the cap 67 and the cap support portion 69 are provided in the left portion of the maintenance portion 141. The cap 67 is included in a maintenance flow path system 700 that will be described later (refer to FIG. 7). The cap support portion 69 has a box shape that is rectangular in a plan view, and its top face is open. The cap 67 is disposed on the inner side of the cap support portion 69.

The cap 67 is formed from a synthetic resin such as rubber or the like, for example. A perimeter wall 672 that configures the cap 67 extends upward from the perimeter of a bottom wall 671 that configures the cap 67. The perimeter wall 672 faces the perimeter of the nozzle disposition area 120 of the nozzle face 111 from below. A partition wall 673 that configures the cap 67 extends upward from the bottom wall 671 and is connected to the front edge and the rear edge of the perimeter wall 672. Therefore, the partition wall 673 divides the area inside the perimeter wall 672 into two parts. In the explanation that follows, the area inside the perimeter wall 672 that is to the left of the partition wall 673 will be called the first area 661, and the area that is to the right of the partition wall 673 will be called the second area 662. The partition wall 673 faces a boundary 127 between the nozzle array 121 and the nozzle arrays 122 to 124 from below. A portion of a cap lip 676 that is formed from the upper edge of the perimeter wall 672 is at the same height as a portion of the cap lip 676 that is formed from the upper edge of the partition wall 673.

Figure 12:
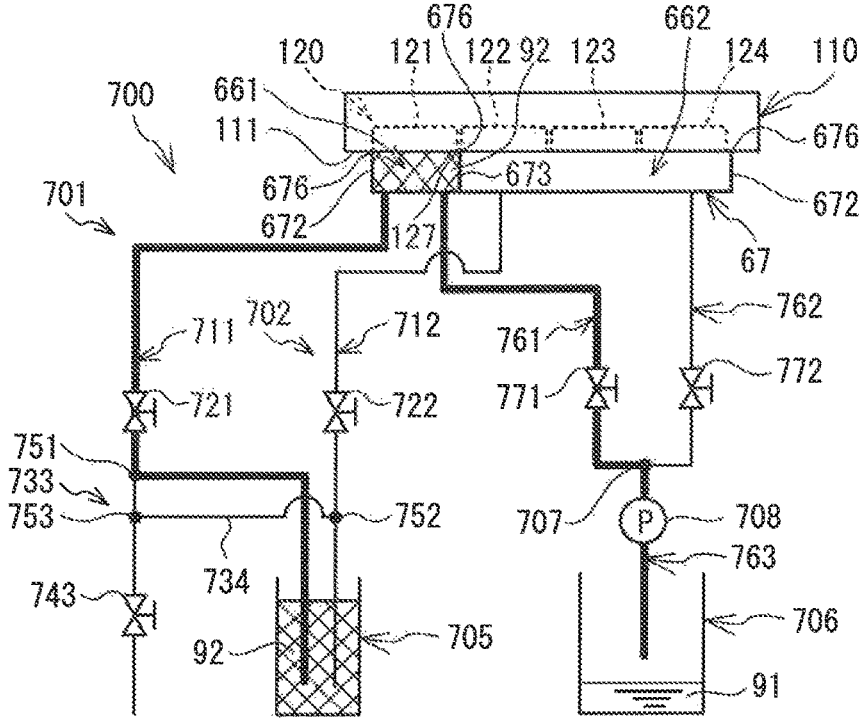
FIG. 12 is a schematic drawing of the maintenance flow path system that shows a state in which a cleaning liquid has been injected into a first area and a nozzle face is soaking.

The cap support portion 69 is moved up and down between a covering position (refer to FIGS. 3 and 12) and a cap withdrawn position (refer to FIG. 7) by the operation of a third drive portion 196 (refer to FIG. 6) that will be described later. The covering position is a position of the cap 67 and the cap support portion 69 where the cap 67 covers the nozzles 112 by tightly affixing the cap 67 with the nozzle face 111. The cap withdrawn position is a position where the cap 67 has withdrawn downward from the nozzle face 111. As shown in FIGS. 3 and 12, in a case where the cap 67 and the cap support portion 69 are in the covering position, the cap lip 676 is tightly affixed to the perimeter of the nozzle disposition area 120 of the nozzle face 111 in the head unit 100, which has moved to the non-printing area 140. The plurality of the nozzles 112 are thus covered (refer to FIG. 7). The upper edge of the partition wall 673, which configures the cap lip 676, is also tightly affixed to the boundary 127 of the nozzle face 111. An ink purge operation and a cleaning operation are performed while the cap 67 and the cap support portion 69 are in the covering position.

In a case where soak processing (FIG. 8, Step S16), which will be described later, is not performed, the CPU 40 of the printer 1, which will be described later, moves the head units 100, 200 from their positions when printing is completed to wipe positions where the wipers 31 execute the nozzle face wiping operation on the nozzle faces 111. After the wipers 31 have executed the nozzle face wiping operation on the nozzle faces 111, the CPU 40 moves the head units 100, 200 to cap positions (hereinafter also called maintenance positions), where the heads 110 are positioned opposite the caps 67. The CPU 40 then performs cover processing (FIG. 8, Step S15), which will be described later, in which the caps 67 cover the nozzles 112. On the other hand, in a case where the soak processing (FIG. 8, Step S16) is performed, the CPU 40 moves the head units 100, 200 from their positions when printing is completed directly to the cap positions, without stopping at the wipe positions.

Electrical Configuration of the Printer 1

As shown in FIG. 6, the printer 1 is provided with the CPU 40, which controls the printer 1. Through a bus 55, the CPU 40 is electrically connected to a ROM (read-only memory) 41, a RAM (random access memory) 42, a head drive portion 43, a main scanning direction drive portion 45, the auxiliary scanning direction drive portion 46, the first drive portion 194, the second drive portion 195, the third drive portion 196, an electromagnetic valve drive portion 197, a pump drive portion 198, a display control portion 48, an operation processing portion 50, an EEPROM (electrically erasable programmable read-only memory) 44, a USB (Universal Serial Bus) connector 47, a temperature detector 23, and a power supply control portion 57. The power supply 56 is connected to the power supply control portion 57.

The ROM 41 stores a control program by which the CPU 40 controls the printer 1, as well as initial values and the like. The RAM 42 temporarily stores various types of data that are used by the control program. The EEPROM 44 stores a soak flag that indicates that soak processing, which will be described later, has been performed, a printing-in-progress flag that indicates that printing is in progress, and a first discharge flag that indicates that first discharge processing has been performed. The EEPROM 44 also stores an elapsed time that starts being counted in the cover processing (Step S14). The head drive portion 43 is electrically connected to the heads 110 that discharge the inks 91. By operating piezoelectric elements that are provided in individual discharge channels in the heads 110 (refer to FIG. 3), the head drive portion 43 causes the inks 91 to be discharged from the nozzles 112 (refer to FIG. 12). The temperature detector 23 measures the temperatures of the heads 110 by detecting the temperatures of the inks inside the nozzles 112, for example. The temperature detector 23 may be provided in the head drive portion 43, for example, but it is not limited to that location.

The main scanning direction drive portion 45 includes the drive motor 19 (refer to FIG. 1) and moves the carriage 20 in the left-right direction (the main scanning direction). The auxiliary scanning direction drive portion 46 includes a motor, a gear, and the like that are not shown in the drawings. By operating the platen drive mechanism 6 (refer to FIG. 1), the auxiliary scanning direction drive portion 46 moves the platen 5 (refer to FIG. 1) in the front-rear direction (the auxiliary scanning direction).

The first drive portion 194 includes a first drive motor (not shown in the drawings), a gear (not shown in the drawings), and the like. By moving the support plate 149 to the left and the right, the first drive portion 194 moves the absorption member 51 to the left and the right. The second drive portion 195 includes a second drive motor (not shown in the drawings), a gear (not shown in the drawings), the moving portion 63 (refer to FIG. 3), and the like. By moving the wiper support portion 32 up and down, the second drive portion 195 moves the wiper 31 up and down. The third drive portion 196 includes a third drive motor (not shown in the drawings), a gear (not shown in the drawings), and the like. By moving the cap support portion 69 up and down, the third drive portion 196 moves the cap 67 up and down.

The electromagnetic valve drive portion 197 opens and closes supply on-off valves 721, 722, an air on-off valve 743, and waste liquid on-off valves 771, 772, all of which will be described later (refer to FIG. 7). The pump drive portion 198 operates the suction pump 708, which will be described later (refer to FIG. 7). The display control portion 48 controls displays on the display 49. The operation processing portion 50 takes operational inputs to the operation buttons 501 and outputs them to the CPU 40. A USB cable from a computer (not shown in the drawings) is connected to the USB connector 47, and commands and printing data are input from the computer. The power supply 56 is an AC/DC adaptor, and it supplies direct current electric power to the CPU 40, the individual drive portions, and the like (hereinafter described as supplying electric power to the printer 1). The power supply control portion 57 controls the turning on and off of the supply of the electric power from the power supply 56 according to commands from the CPU 40. Even when the electric power has been turned off, weak electric power is supplied to the CPU 40 and the operation processing portion 50, such that the CPU 40 is able to detect a command from the operation buttons 501 to turn on the electric power.

Structure of the Maintenance Flow Path System 700

Figure 7:
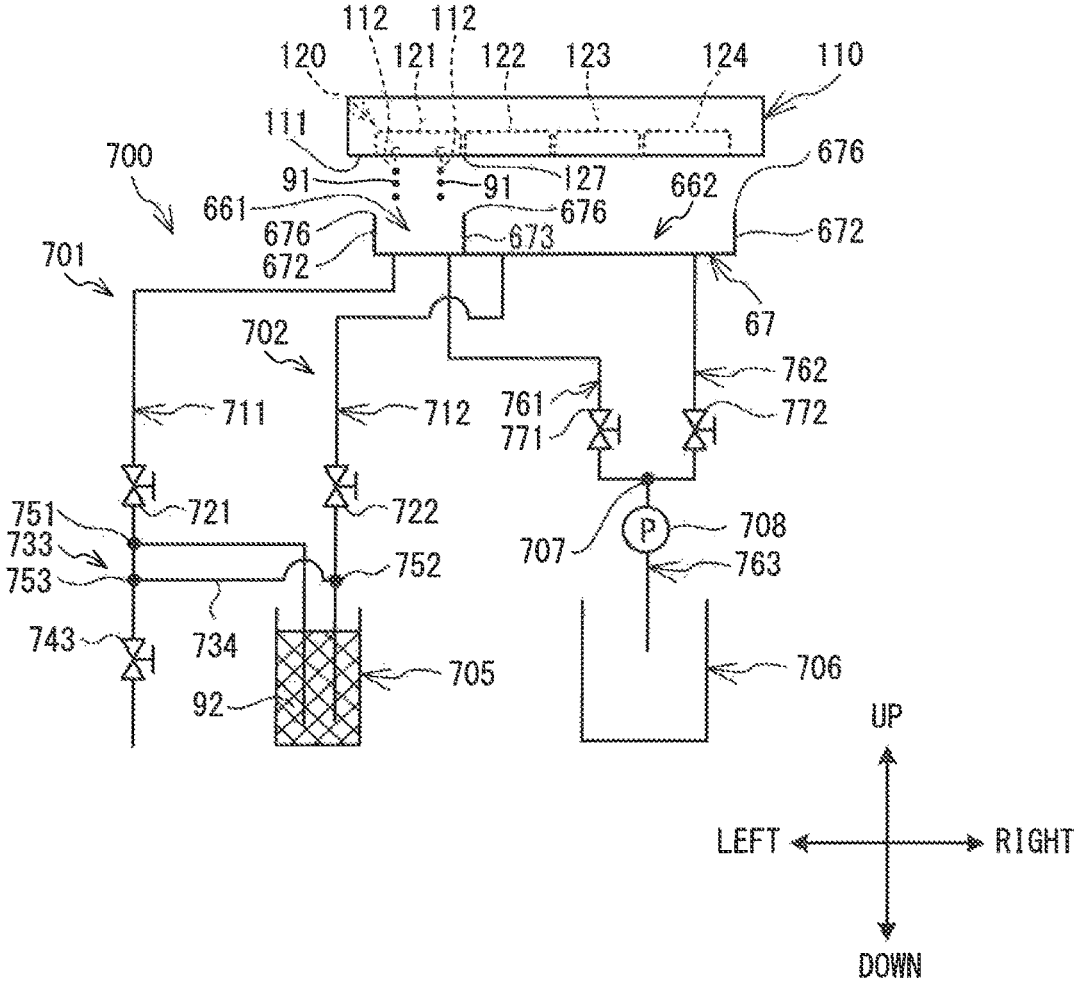
FIG. 7 is a schematic drawing of a maintenance flow path system in a state in which the cap is in a cap withdrawn position.
Figure 10:
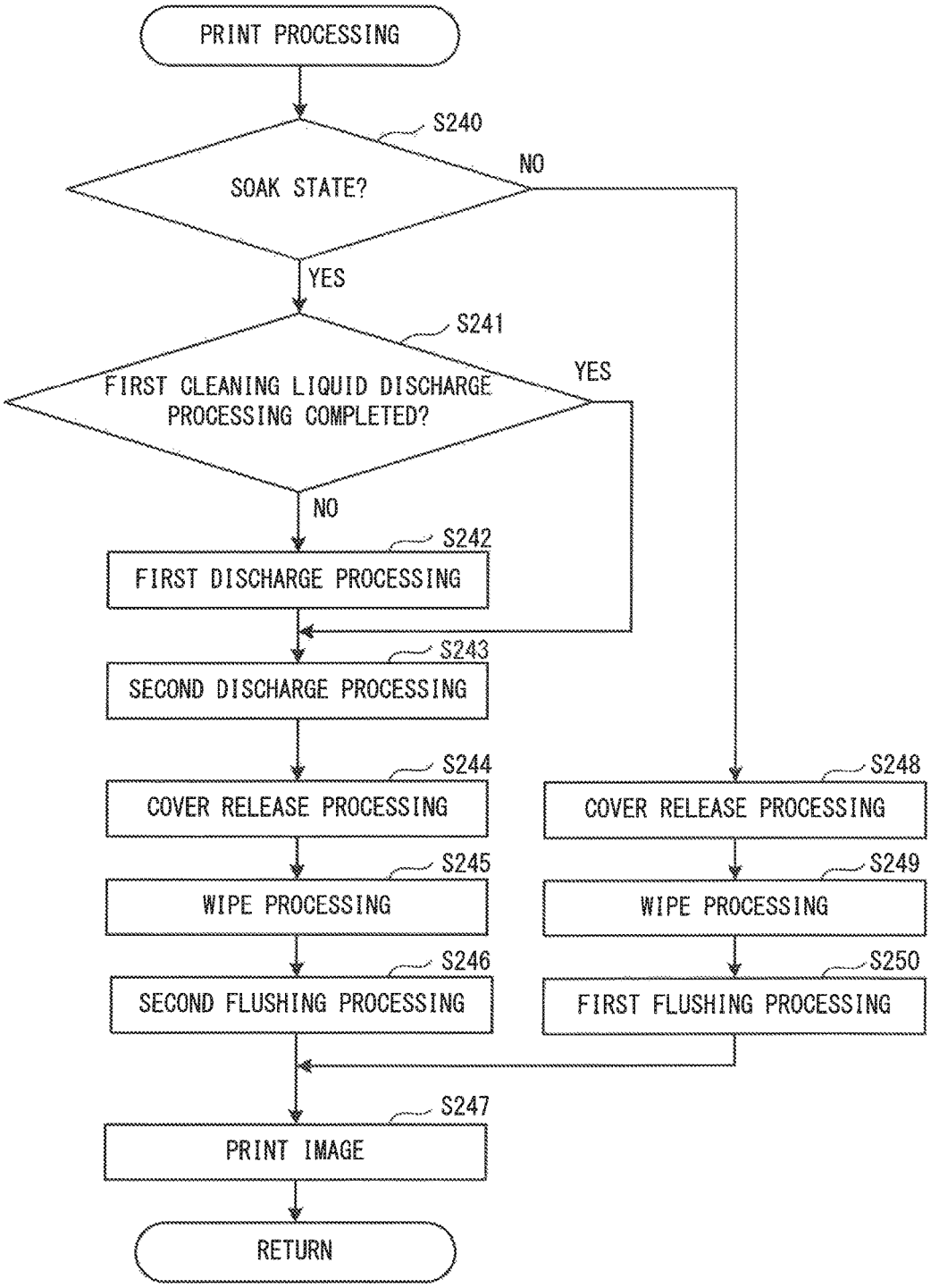
FIG. 10 is a flowchart of print processing.

As shown in FIG. 7, the printer 1 is provided with the maintenance flow path system 700. To make the drawing easier to understand, the maintenance flow path system 700 and the head 110 are shown schematically in FIG. 7. The maintenance flow path system 700 is a mechanism through which the inks 91, the cleaning liquid 92, and air flow when the soak processing (refer to FIG. 8, Step S16), the first discharge processing (refer to FIG. 8, Step S23; FIG. 10, Step S242), and second discharge processing (FIG. 10, Step S243), all of which will be described later, are performed. The maintenance flow path system 700 is provided with a cleaning liquid tank 705, supply flow paths 711, 712, the supply on-off valves 721, 722, a gas flow path 733, a connecting path 734, the air on-off valve 743, waste liquid flow paths 761, 762, 763, the waste liquid on-off valves 771, 772, the suction pump 708, and a waste liquid tank 706.

The cleaning liquid tank 705 is a container that stores the cleaning liquid 92. The supply flow path 711 is a flow path that is connected to the cleaning liquid tank 705 and to the first area 661 in the cap 67. The operating of the suction pump 708 makes it possible for the supply flow path 711 to take the cleaning liquid 92 that is stored in the cleaning liquid tank 705 and supply it to the first area 661 in the cap 67. The supply flow path 712 is a flow path that is connected to the cleaning liquid tank 705 and to the second area 662 in the cap 67. In the same manner as the supply flow path 711, the supply flow path 712 is able to supply the cleaning liquid 92 to the second area 662 in the cap 67.

The supply on-off valves 721, 722 are electromagnetic valves that are provided in the supply flow paths 711, 712 and that open and close the supply flow paths 711, 712. The gas flow path 733 is connected to the supply flow path 711 at a convergence portion 751 that is located between the supply on-off valve 721 and the cleaning liquid tank 705. Therefore, the gas flow path 733 is connected to the first area 661 of the cap 67 through the supply flow path 711. The opposite end of the gas flow path 733 from the convergence portion 751 is open to the atmosphere. Therefore, the gas flow path 733 is a flow path through which air passes. The air on-off valve 743 is an electromagnetic valve that is provided in the gas flow path 733, and it opens and closes the gas flow path 733. The gas flow path 733 is also connected to the supply flow path 712 by the connecting path 734. One end of the connecting path 734 is connected to a convergence portion 753 between the convergence portion 751 and the air on-off valve 743. The other end of the connecting path 734 is connected to the supply flow path 712 at a convergence portion 752 that is located between the supply on-off valve 722 and the cleaning liquid tank 705. Therefore, the gas flow path 733 is connected to the second area 662 of the cap 67 through the connecting path 734 and the supply flow path 712.

Note that the gas flow path 733 may also be connected directly to the cap 67, without being connected to the supply flow paths 711, 712. In that case, the single gas flow path 733 may be divided into two branches, with one branch being connected to the first area 661 and the other branch being connected to the second area 662. The gas flow path 733 may also be provided in the form of two gas flow paths, with one of the gas flow paths 733 being connected to the first area 661 and the other of the gas flow paths 733 being connected to the second area 662. The convergence portion 752 may also be located between the cap 67 and the supply on-off valve 722 in the supply flow path 712, and the convergence portion 753 may also be located between the cap 67 and the supply on-off valve 721 in the supply flow path 711. In that case, the gas flow path 733, which is connected to the convergence portions 752, 753, may be provided as a single gas flow path, and it may also be provided in the form of two gas flow paths.

The waste liquid flow path 761 is connected to the first area 661 of the cap 67. The waste liquid flow path 762 is connected to the first area 662 of the cap 67. The waste liquid flow paths 761, 762 converge at a convergence portion 707 to form the single waste liquid flow path 763. The waste liquid flow path 763 is connected to the waste liquid tank 706. The waste liquid tank 706 is a container that stores the inks 91 and the cleaning liquid 92 that have been drained out of the cap 67. The suction pump 708 is provided in the waste liquid flow path 763. The operation of the suction pump 708 enables the waste liquid flow paths 761, 762, 763 to drain the inks 91 and the cleaning liquid 92 out of the cap 67. The waste liquid on-off valves 771, 772 are electromagnetic valves that are respectively provided in the waste liquid flow paths 761, 762 and that respectively open and close the waste liquid flow paths 761, 762.

In the explanation that follows, the supply flow path 711, the gas flow path 733, and the waste liquid flow paths 761, 763, all of which are connected to the first area 661, will be called the first flow path system 701. The supply flow path 712, the gas flow path 733, the connecting path 734, and the waste liquid flow paths 762, 763, all of which are connected to the second area 662, will be called the second flow path system 702.

Maintenance Processing

When the power supply to the printer 1 is turned on, the CPU 40 reads the control program that is stored in the ROM 41 and controls the printer 1. A control program for the maintenance processing, which is shown in FIG. 8, is included in the control program that the CPU 40 reads. The CPU 40 of the printer 1 performs the maintenance processing that is shown in FIG. 8 according to the control program. The maintenance processing is performed under the control of the CPU 40. First, the CPU 40 determines whether printing has been completed (Step S11). For example, in a case where the printing-in-progress flag, which indicates that printing is in progress, has been erased from the EEPROM 44, the CPU 40 determines that printing has been completed (YES at Step S11). The printing-in-progress flag is stored in the EEPROM 44 while the printing data are being printed, and it is erased when the printing is completed.

In a case where the CPU 40 has determined that printing has been completed (YES at Step S11), the CPU 40 determines whether a head temperature T is higher than a reference temperature Tw (Step S12). The reference temperature Tw is 45 degrees Celsius, for example. In a case where the CPU 40 does not determine, based on the output from the temperature detector 23, that the head temperature T is higher than the reference temperature Tw (NO at Step S12), the CPU 40 performs the wipe processing (Step S13). In a case where the CPU 40 has determined, based on the output from the temperature detector 23, that the head temperature T is higher than the reference temperature Tw (YES at Step S12), the CPU 40 performs the cover processing (Step S14) and the soak processing (Step S16). Note that the CPU 40 may perform the determination processing at Step S12 between the completion of print processing (Step S18; Step S247) that prints the image on the printing medium and the moving of the head 110 to the maintenance position, where it is opposite the cap 67, or in a state in which the head 110 has moved to the maintenance position, or immediately prior to the completion of the print processing. However, in the present embodiment, it is preferable for the determination processing at Step S12 to be performed between the completion of the print processing and the moving of the head 110 to the wipe position, because whether or not the head 110 is in a printing position, it is closer to the wipe position than to the cap position. It is also better to perform the determination processing at Step S12 after printing has been completed than in the final stage of the print processing, because the effect of heat generated by printing with an integrated drive circuit that is contained in the head drive portion 43 is thought to be a major cause of failure to discharge the inks 91 from the nozzles 112.

In the wipe processing (Step S13), the CPU 40 performs the nozzle face wiping operation that was described previously. That causes the wiper 31 to slide along the nozzle face 111 and wipe the ink 91 off of the nozzle face 111. Next, the CPU 40 may perform the wiper wiping operation that was described previously.

Following the wipe processing (Step S13), the CPU 40 performs the cover processing (Step S15). In the cover processing (Step S15), the CPU 40 operates the third drive portion 196 (refer to FIG. 6) to move the cap support portion 69 upward, thus moving the cap 67 from the cap withdrawn position (refer to FIG. 7) to the covering position (refer to FIGS. 3 and 12). The cap 67 thus enters a covering state in which it covers the nozzles 112 on the nozzle face 111. Note that if the air on-off valve 743 is closed when the cover processing (Step S15) is performed, the pressure inside the cap 67 will increase when the cap 67 is pressed against the nozzle face 111, creating the possibility that the meniscuses in the nozzles 112 will be destroyed. Therefore, when performing the cover processing (Step S15), the CPU 40 opens the air on-off valve 743 and lets air flow between the first area 661 and the second area 662 before affixing the cap lip 676 tightly to the nozzle face 111. The air inside the first area 661 and the second area 662 thus escapes easily to the outside through the gas flow path 733, preventing the pressure inside the cap 67 from increasing. Note that the air on-off valve 743 may also be left in the closed state.

Following the cover processing (Step S15), the CPU 40 determines whether a print command has been received (Step S17). The print command is transmitted to the CPU 40 from the operation processing portion 50 based on an operation of the operation buttons 501 or is transmitted to the CPU 40 from a computer (not shown in the drawings) that is connected to the CPU 40 through the USB connector 47 and a network such as a local area network (LAN) or the like (not shown in the drawings). In a case where the print command has been received (YES at Step S17), the CPU 40 performs the print processing (Step S18).

Print Processing (Step S18)

The CPU 40 performs the print processing (Step S18) according to the subroutine flowchart that is shown in FIG. 10. In the print processing, the CPU 40 first determines whether the nozzle face 111 is in a soak state (Step S240). In a case where the soak flag is stored in the EEPROM 44, the CPU 40 determines that the nozzle face 111 is in the soak state (YES at Step S240). In a case where the soak flag is not stored in the EEPROM 44, the CPU 40 determines that the nozzle face 111 is not in the soak state (NO at Step S240). In a case where the soak processing (Step S16) has not been performed, the soak flag is not stored in the EEPROM 44. Therefore, the CPU 40 determines that the nozzle face 111 is not in the soak state (NO at Step S240) and performs cover release processing (Step S248). For example, the CPU 40 operates the third drive portion 196 (refer to FIG. 6) to move the cap support portion 69 downward, thus moving the cap 67 from the covering position (refer to FIGS. 3 and 13) to the cap withdrawn position (refer to FIG. 7). Next, the CPU 40 performs the wipe processing (Step S249). The wipe processing at Step S249 is the same processing as the wipe processing at Step S13.

Following the processing at Step S249, the CPU 40 performs first flushing processing (Step S250). The first flushing processing is processing that performs a first flushing, which discharges a first amount of the ink 91 from each of the nozzles 112 onto the flushing receiving portion 145 (refer to FIG. 2). The ink 91 whose viscosity has increased is discharged from the nozzles 112 by the performing of the first flushing. For example, in the first flushing, the first amount of the ink 91 that is discharged from each of the nozzles 112 may be the total amount of the ink 91 that is discharged by five rounds of an operation in which five hundred drops of the ink 91 are discharged. Next, the CPU 40, by using the head drive portion 43 to control the heads 110, performs printing of the image (Step S247) by discharging the inks 91 from the nozzles 112. When the CPU 40 starts the printing of the image, it stores the printing-in-progress flag in the EEPROM 44, and when it completes the printing, it deletes the printing-in-progress flag from the EEPROM 44 and returns the processing to Step S11.

In a case where the CPU 40 has not received the print command (NO at Step S17), the CPU 40 determines whether it has received a head cleaning command (Step S19). The head cleaning command is transmitted to the CPU 40 from the operation processing portion 50 based on an operation of the operation buttons 501 or is transmitted to the CPU 40 from a computer (not shown in the drawings) that is connected to the CPU 40 through the USB connector 47 and a network such as a local area network (LAN) or the like (not shown in the drawings). In a case where the head cleaning command has been received (YES at Step S19), the CPU 40 performs head cleaning processing (Step S20).

Head Cleaning Processing

Figure 9:
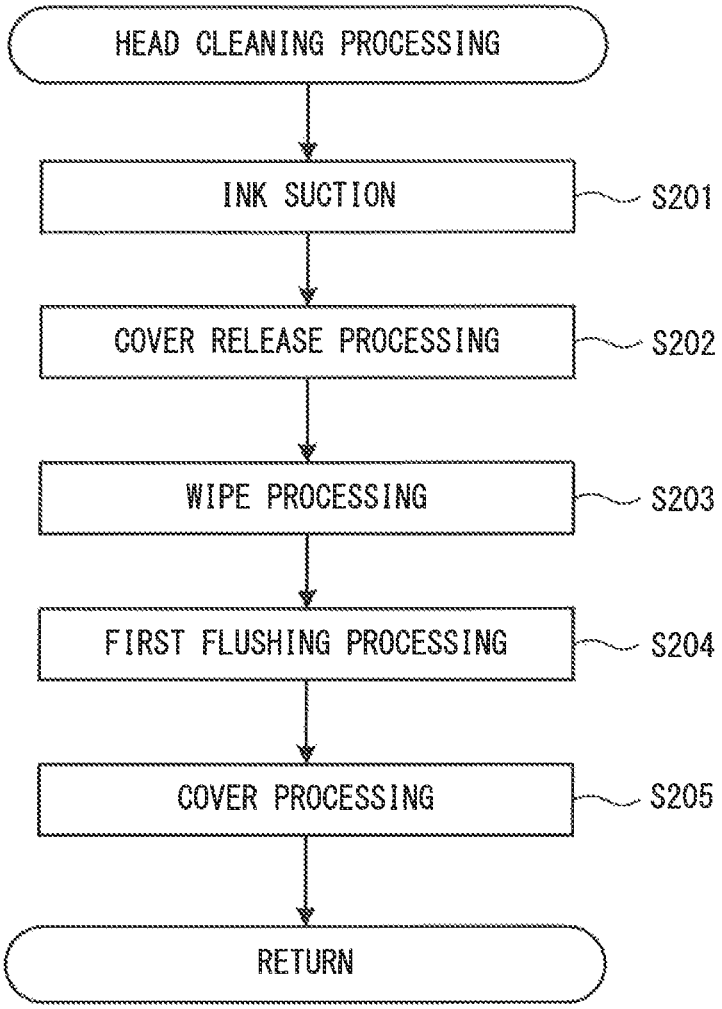
FIG. 9 is a flowchart of head cleaning processing.

The CPU 40 performs the head cleaning processing (Step S20) according to the subroutine flowchart that is shown in FIG. 9. In the head cleaning processing, the CPU 40 first performs the ink suction (Step S201) that is called a purge.

For example, the CPU 40 performs a purge that draws the ink 91 inside the nozzles 112 of the nozzle array 121 into the first area 661 of the cap 67. At Step S201, the CPU 40 controls the various electromagnetic valves such that the cleaning liquid 92 is not drawn into the first area 661 from the supply flow path 711 and outside air is not drawn into the first area 661 from the gas flow path 733. For example, the CPU 40 may open the waste liquid on-off valve 771 and close the supply on-off valve 721 and the air on-off valve 743. Next, the CPU 40 operates the suction pump 708 at a specified revolution speed for a specified period of time. Because the supply on-off valve 721 and the air on-off valve 743 are closed, negative pressure is created inside the first area 661 as the suction pump 708 applies suction to the first area 661. The ink 91 inside the nozzles 112 of the nozzle array 121 is thus drawn into the first area 661. A portion of the ink 91 that has been drawn in may flow to the waste liquid tank 706 through the waste liquid flow paths 761, 763. Next, the CPU 40 stops the suction pump 708. That is, the operation of the suction pump 708 is stopped. At Step S201, the CPU 40 also performs the ink suction in the same manner, by operating the suction pump 708 at a specified revolution speed for a specified period of time, to draw the inks 91 inside the nozzles 112 of the nozzle arrays 122 to 124 into the second area 662.

Following the processing at Step S201, the CPU 40 performs the cover release processing (Step S202), which moves the cap 67 from the covering position on the nozzles 112 to the cap withdrawn position (refer to FIG. 7). Next, the CPU 40 performs the wipe processing (Step S203). The wipe processing (Step S203) is the same processing as the wipe processing (Step S13) that is shown in FIG. 8. Following the processing at Step S203, the CPU 40 performs the first flushing processing (Step S204). The first flushing processing (Step S204) is the same processing as the first flushing processing (Step S250) that is shown in FIG. 10. Next, the CPU 40 performs the cover processing (Step S205). The cover processing (Step S205) is the same processing as the cover processing (Step S15) that is shown in FIG. 8. After the processing at Step S205, the CPU 40 returns the processing to Step S17, which is shown in FIG. 8.

Figure 13:
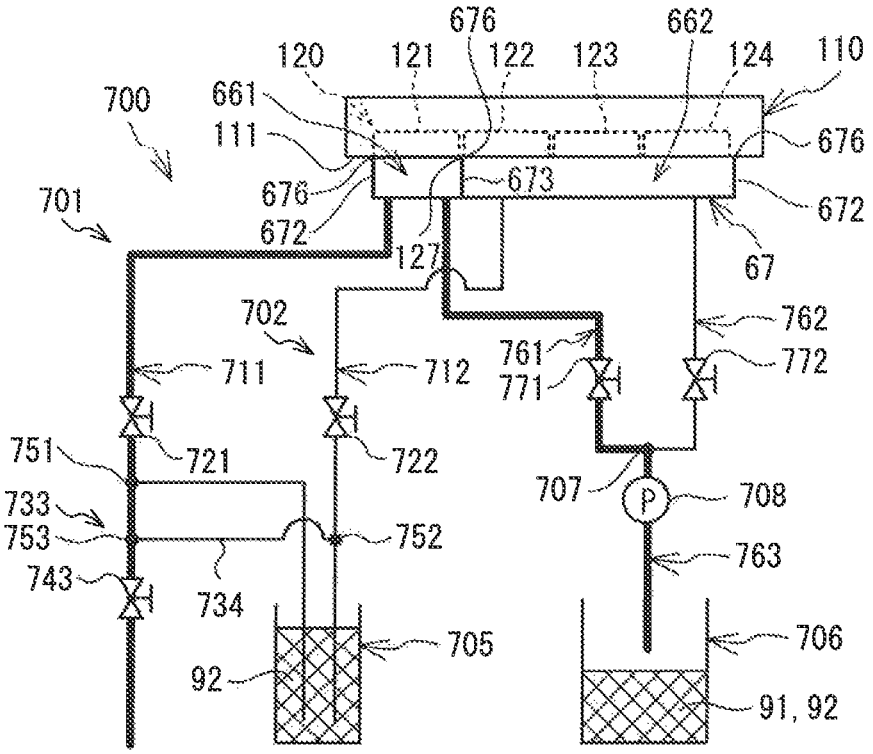
FIG. 13 is a schematic drawing of the maintenance flow path system that shows a state in which the cleaning liquid has been drained out of the first area.

In the processing at Step S12, in a case where the CPU 40 has determined, based on the output from the temperature detector 23, that the head temperature T is higher than the reference temperature Tw (YES at Step S12), the CPU 40 performs the cover processing (Step S14). In the cover processing (Step S14), the CPU 40 performs the same processing as the cover processing (Step S15) that is shown in FIG. 8, and also starts a timer that counts the time. The time that the timer counts is stored in the EEPROM 44. With the cap 67 in the covering state, as shown in FIG. 12, the nozzle array 121 is disposed in the first area 661, and the nozzle arrays 122 to 124 are disposed in the second area 662. In FIGS. 12 and 13, the flow paths that are open based on the open and closed states of the various electromagnetic valves are indicated by thicker lines than the other flow paths. Following the processing at Step S14, the CPU 40 performs the soak processing (Step S16).

Soak Processing

In the soak processing (Step S16), the CPU 40 performs a soak that puts the cleaning liquid 92 in contact with the nozzle face 111 by using the first flow path system 701 to fill the first area 661 with the cleaning liquid 92, as shown in FIG. 12. While the CPU 40 is performing the soak processing, unless otherwise specified for the second flow path system 702, it is preferable for the supply on-off valve 722 and the waste liquid on-off valve 772, which are the electromagnetic valves that are located in the second flow path system 702, to be closed. The air on-off valve 743 may be closed, and it may also be open. Accordingly, in the following explanation of the soak processing, an explanation of the control of the electromagnetic valves that are located in the second flow path system 702 will be omitted.

The CPU 40 supplies the cleaning liquid 92 from the cleaning liquid tank 705 to the first area 661 of the cap 67 through the supply flow path 711. First, for example, the CPU 40 may operate the valves. For example, the CPU 40 closes the air on-off valve 743 and opens the supply on-off valve 721, as shown in FIG. 12. At this time, the waste liquid on-off valve 771 is open. Next, the CPU 40 operates the suction pump 708 for a specified period of time at a specified revolution speed. When the suction pump 708 is operated, the cleaning liquid 92 is supplied from the cleaning liquid tank 705 to the first area 661 of the cap 67 through the supply flow path 711, and the cleaning liquid 92 soaks the nozzle face 111 (refer to FIG. 12). Next, the CPU 40 stops the suction pump 708, closes the supply on-off valve 721, and closes the waste liquid on-off valve 771. The CPU 40 stores the soak flag in the EEPROM 44. The soak prevents the nozzles 112 in nozzle face 111 from drying out. Note that the CPU 40 also performs the same sort of processing for the second area 662. Therefore, the cleaning liquid 92 is supplied from the cleaning liquid tank 705 to the second area 662 of the cap 67 through the supply flow path 712, and the cleaning liquid 92 soaks the nozzle face 111. Accordingly, in a state in which the cleaning liquid 92 has been supplied to the cap 67 and the cleaning liquid 92 has soaked the nozzle face 111, it is possible to keep the cleaning liquid 92 inside the cap 67. Note that the soak flag indicates a state in which the cleaning liquid 92 is soaking the nozzle face 111.

Next, the CPU 40 determines whether an elapsed time H since the covering state of the cap 67 was established by the cover processing (Step S14) is greater than a specified time N (Step S21). The elapsed time H is stored in the EEPROM 44 and is the time that is indicated by the timer that started to count the time in the cover processing (Step S14). An example of the specified time N is 300 seconds. In a case where the CPU 40 does not determine that the elapsed time H is greater than the specified time N (NO at Step S21), the CPU 40 determines whether it has received the print command (Step S22). The determination processing at Step S22 is the same determination processing as the determination processing at Step S17. In a case where the CPU 40 has determined that it has received the print command (YES at Step S22), the CPU 40 performs the print processing (Step S24).

Print Processing (Step S24)

The CPU 40 performs the print processing (Step S24) according to the subroutine flowchart that is shown in FIG. 10. In the print processing, the CPU 40 first determines whether the nozzle face 111 is in the soak state (Step S240). The soak processing (Step S16) has been performed, and the soak flag is stored in the EEPROM 44, so the CPU 40 determines that the nozzle face 111 is in the soak state (YES at Step S240). Next, the CPU 40 determines whether the first discharge processing has been completed (Step S241). The first discharge processing is processing that is performed at Step S242, which will be described later, and at Step S23 in FIG. 8. The first discharge processing is processing that discharges the cleaning liquid 92 from the inside of the cap 67 while the cap 67 is in the covering state, in which it covers the nozzle face 111. After performing the first discharge processing, the CPU 40 stores the first discharge flag in the EEPROM 44. The first discharge flag is a flag that indicates that the first discharge processing has been performed.

The first discharge processing (Step S23) has not been performed prior to the print processing (Step S24), so the first discharge flag has not been stored in the EEPROM 44. Therefore the CPU 40 determines that the first discharge processing has not been completed (NO at Step S241) and performs the first discharge processing (Step S242). The first discharge processing is processing that discharges the cleaning liquid 92 from the inside of the cap 67 while the cap 67 is in the covering state, in which it covers the nozzle face 111. For example, the CPU 40 operates the suction pump 708 at the same time that it opens the air on-off valve 743, the waste liquid on-off valve 771, and the supply on-off valve 721. In the processing at Step S242, the cleaning liquid 92 is discharged from the first area 661 through the waste liquid flow paths 761, 763. The suction force of the suction pump 708 causes air to flow into the first area 661 through the gas flow path 733 and causes the cleaning liquid 92 inside the first area 661 to be drained into the waste liquid tank 706 through the waste liquid flow paths 761, 763, as shown in FIG. 13. Next, the CPU 40 stops the suction pump 708.

Next, the CPU 40 performs the second discharge processing (Step S243). The second discharge processing is processing that uses the suction force of the suction pump 708 to suck the cleaning liquid 92 and the air from the inside of the cap 67 while the cap 67 is in a state in which it has moved an short distance away from the nozzle face 111. The short distance may be one millimeter, for example. The CPU 40 may operate the third drive portion 196 (refer to FIG. 6) to move the cap support portion 69 downward by one millimeter, for example. The cleaning liquid 92 inside the cap 67 is mainly removed by the first discharge processing (Step S242), but the cleaning liquid 92 tends to remain around the inner side of the upper edge of the cap 67. If the cap 67 withdraws from the nozzle face 111 leaving some of the cleaning liquid 92 remaining around the inner side of the upper edge of the cap 67, large liquid droplets tend to remain on the nozzle face 111 in locations that are in contact with the cap 67. In the present embodiment, using the suction pump 708 to suck the cleaning liquid 92 and the air from the inside of the cap 67 while the cap 67 is in the state in which it has moved an short distance away from the nozzle face 111 makes it possible to decrease the amount of the cleaning liquid 92 that adheres to the nozzle face 111. After the second discharge processing, the CPU 40 closes the supply on-off valve 721, the waste liquid on-off valve 771, and the air on-off valve 743. The CPU 40 deletes the soak flag and the first discharge flag from the EEPROM 44.

Next, the CPU 40 performs the cover release processing (Step S244). The cover release processing (Step S244) is the same processing as the cover release processing (Step S202) that is shown in FIG. 9. Next, the CPU 40 performs the wipe processing (Step S245). The wipe processing (Step S245) is the same processing as the wipe processing (Step S13) that is shown in FIG. 8.

Next, the CPU 40 performs a second flushing processing (Step S246). The second flushing processing is processing that performs a second flushing, which discharges the ink 91 from the nozzles 112 onto the flushing receiving portion 145 (refer to FIG. 2). A second amount of the ink 91 that is discharged from each of the nozzles 112 by the second flushing is greater than the first amount of the ink 91 that is discharged from each of the nozzles 112 by the first flushing. For example, in the second flushing, the second amount of the ink 91 that is discharged from each of the nozzles 112 may be the total amount of the ink that is discharged by fifteen rounds of an operation in which five hundred drops of the ink 91 are discharged. When the nozzle face 111 is in the soak state, the cleaning liquid 92 penetrates into the interiors of the nozzles 112. Discharging more of the ink 91 in the second flushing than in the first flushing makes it possible to discharge the cleaning liquid 92 from the interiors of the nozzles 112 and to drain the cleaning liquid 92 thoroughly from the interiors of the nozzles 112.

Next, the CPU 40 performs the printing of the image (Step S247). When the CPU 40 starts the printing, it stores the printing-in-progress flag in the EEPROM 44 (Step S247), and when the printing is completed, the CPU 40 deletes the printing-in-progress flag from the EEPROM 44 (Step S247). The CPU 40 then returns the processing to Step S11.

In the determination processing at Step S22, in a case where the CPU 40 does not determine that it has received the print command (NO at Step S22), it determines whether it has received the head cleaning command (Step S25). The determination at Step S25 is the same determination processing as the determination at Step S19. In a case where the CPU 40 has determined that it has received the head cleaning command (YES at Step S25), it performs soak time head cleaning processing (Step S26).

Soak Time Head Cleaning Processing

Figure 11:
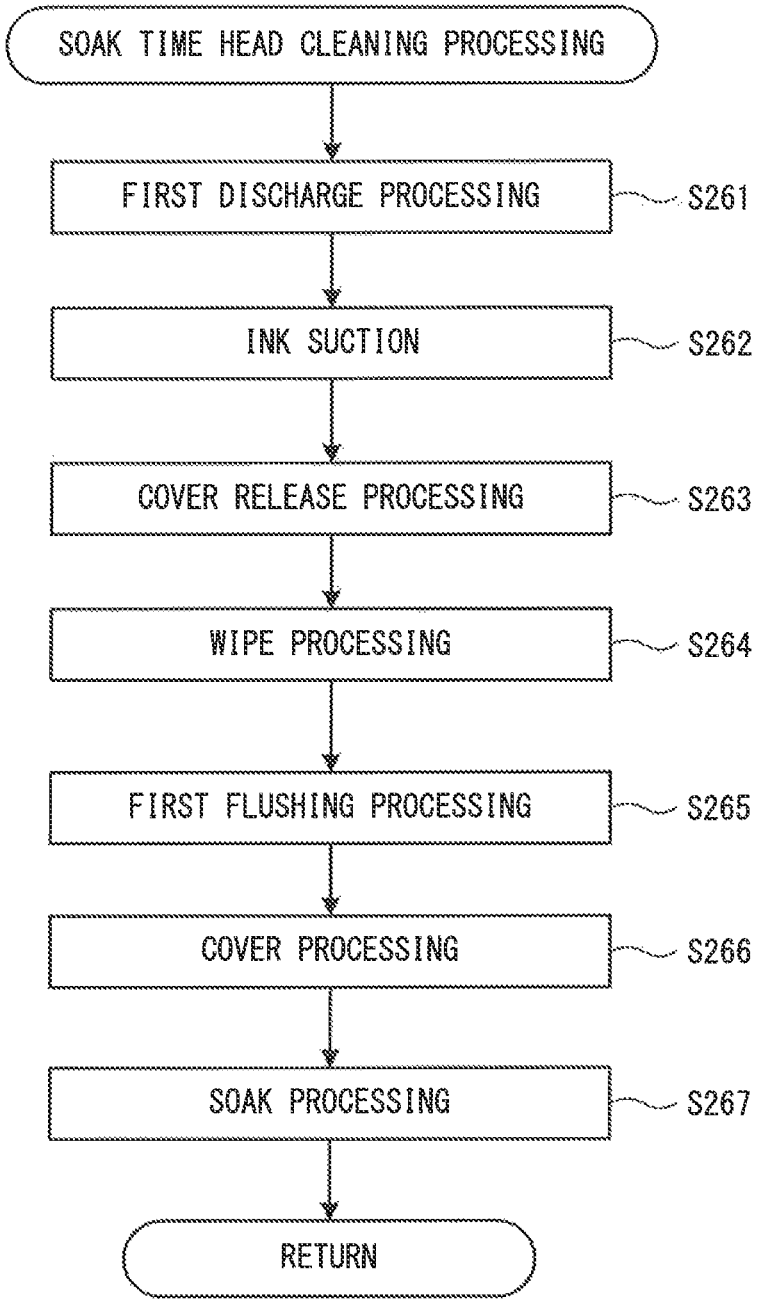
FIG. 11 is a flowchart of soak time head cleaning processing.

The CPU 40 performs the soak time head cleaning processing (Step S26) according to the subroutine flowchart that is shown in FIG. 11. In the soak time head cleaning processing, the CPU 40 first performs the first discharge processing (Step S261). The processing at Step S261 is the same processing as at Step S242 in FIG. 10. Next, the CPU 40 performs the ink suction (Step S262). The processing at Step S262 is the same processing as at Step S201 in FIG. 9. Next, the CPU 40 performs the cover release processing (Step S263). The processing at Step S263 is the same processing as at Step S202 in FIG. 9. Next, the CPU 40 performs the wipe processing (Step S264). The processing at Step S264 is the same processing as at Step S13 in FIG. 8. Next, the CPU 40 performs the first flushing processing (Step S265). The processing at Step S265 is the same processing as at Step S204 in FIG. 9. Next, the CPU 40 performs the cover processing (Step S266). The processing at Step S266 is the same processing as at Step S205 in FIG. 9. Next, the CPU 40 performs the soak processing (Step S267). The processing at Step S267 is the same processing as at Step S16 in FIG. 8. After the processing at Step S267, the CPU 40 returns the processing to Step S21, which is shown in FIG. 8.

In a case where the CPU 40 has determined that the elapsed time H is greater than the specified time N (YES at Step S21), the CPU 40 performs the first discharge processing (Step S23). The processing at Step S23 is the same processing as at Step S242 in FIG. 10. After performing the first discharge processing, the CPU 40 stores the first discharge flag in the EEPROM 44. After the processing at Step S23, the CPU 40 determines whether it has received the print command (Step S27). The determination at Step S27 is the same determination processing as the determination at Step S17. In a case where the CPU 40 has determined that it has received the print command (YES at Step S27), the CPU 40 performs the print processing (Step S28).

Print Processing (Step S28)

The CPU 40 performs the print processing (Step S28) according to the subroutine flowchart that is shown in FIG. 10. In the print processing (Step S28), the CPU 40 first determines whether the nozzle face 111 is in the soak state (Step S240). The soak processing (Step S16) has been performed, and the soak flag is stored in the EEPROM 44, so the CPU 40 determines that the nozzle face 111 is in the soak state (YES at Step S240). Next, the CPU 40 determines whether the first discharge processing has been completed (Step S241). The first discharge processing (Step S23) has been performed, and the first discharge flag is stored in the EEPROM 44, so the CPU 40 determines that the first discharge processing has been completed (YES at Step S241), then performs the second discharge processing (Step S243) without performing the first discharge processing (Step S242). After completing the second discharge processing, the CPU 40 deletes the soak flag and the first discharge flag from the EEPROM 44. Next, the CPU 40 performs the cover release processing (Step S244). Next, the CPU 40 performs the wipe processing (Step S245). Next, the CPU 40 performs the second flushing processing (Step S246). Next, the CPU 40 performs the printing of the image (Step S247). When the CPU 40 starts the printing, it stores the printing-in-progress flag in the EEPROM 44, and when the printing is completed, the CPU 40 deletes the printing-in-progress flag from the EEPROM 44. The CPU 40 then returns the processing to Step S11.

In the determination processing at Step S27, in a case where the CPU 40 does not determine that it has received the print command (NO at Step S27), the CPU 40 determines whether it has received the head cleaning command (Step S29). The determination at Step S29 is the same determination processing as the determination at Step S19. In a case where the CPU 40 has determined that it has received the head cleaning command (YES at Step S29), the CPU 40 performs the head cleaning processing (Step S30), and in a case where the CPU 40 does not determine that it has received the head cleaning command (NO at Step S29), the CPU 40 returns the processing to Step S27.

Head Cleaning Processing (Step S30)

The CPU 40 performs the head cleaning processing (Step S30) according to the subroutine flowchart that is shown in FIG. 9. In the head cleaning processing (Step S30), the CPU 40 first performs the ink suction (Step S201). Next, the CPU 40 performs the cover release processing (Step S202). Next, the CPU 40 performs the wipe processing (Step S203). Next, the CPU 40 performs the first flushing processing (Step S204). Next, the CPU 40 performs the cover processing (Step S205). After the processing at Step S205, the CPU 40 returns the processing to Step S17, which is shown in FIG. 8.

Soak

The inventor has confirmed that under the conditions enumerated below, the cleaning liquid 92 soaks the nozzle face 111 in the soak processing (Steps S16, S267).

(1) The second area 662 that is shown in FIG. 2 measures 22 millimeters from left to right and 39 millimeters from front to rear, and a distance L from the nozzle face 111 to the bottom face of the second area 662 is 1.1 millimeters. In other words, a surface area S of the second area 662 in a plan view is 858 square millimeters, and a volume V of the second area 662 is 943.8 cubic millimeters.

(2) The revolution speed of the suction pump 708 in the soak processing is 300 rpm.

(3) A surface tension F of the cleaning liquid 92 is 68.5 mN/m.

Note that the first area 661 that is shown in FIG. 2 measures 6 millimeters from left to right and 39 millimeters from front to rear, and the distance L from the nozzle face 111 to the bottom face of the first area 661 is 1.1 millimeters. In other words, the surface area of the first area 661 in a plan view is 234 square millimeters, and the volume V of the first area 661 is 257.4 cubic millimeters. Accordingly, the volume V of the first area 661 is smaller than the volume V of the second area 662. Therefore, in the soak processing, if the cleaning liquid 92 soaks the nozzle face 111 in the second area 662 under the conditions (2) and (3), then it stands to reason that the cleaning liquid 92 will soak the nozzle face 111 in the first area 661 under the conditions (2) and (3).

Based on the confirmed results for the conditions (1) to (3) above, it is thought that in the soak processing, the cleaning liquid 92 will soak the nozzle face 111 under the conditions hereinafter described. Specifically, if the volumes V of the spaces within the cap 67 to which the suction pump 708 applies suction are reduced, the amount of the cleaning liquid 92 that is needed to fill the spaces will be reduced. Accordingly, it becomes easier for the cleaning liquid 92 to soak the nozzle face 111. Therefore, one of the surface area S and the distance L may be reduced in order to reduce the volume V. Reducing the distance L shortens the distance to the nozzle face 111, so that is desirable for soaking purposes. Soaking also becomes easier in the soak processing if the revolution speed of the suction pump 708 is not less than 300 rpm, because the suction force with which the suction pump 708 draws the cleaning liquid 92 into the spaces inside the cap 67 becomes stronger.

The cleaning liquid 92 also spreads more readily, and soaking becomes more difficult, if the surface tension F of the cleaning liquid 92 is less than 68.5 mN/m. Conversely, the cleaning liquid 92 becomes more resistant to spreading, and soaking becomes easier, if the surface tension F of the cleaning liquid 92 is not less than 68.5 mN/m. Note that the cleaning liquid 92 contains a surface active agent, and if the ratio of the surface active agent increases, the surface tension F becomes greater. The surface tension of the ink 91 is approximately 30 mN/m, and the surface tension F of the cleaning liquid 92 is higher than the surface tension of the ink 91.

As explained previously, in the embodiment that is described above, the printer 1 is provided with the head 110, the cap 67, the supply flow paths 711, 712, and the waste liquid flow paths 761 to 763. The head 110 is provided with the nozzle face 111, in which the nozzles 112 are arrayed. The CPU 40 of the printer 1 determines, based on the input value from the temperature detector 23, whether the head temperature T is higher than the reference temperature Tw (Step S12). The determination processing at Step S12 is an example of first determination processing. In the determination processing (Step S12), in a case where it is not determined that the head temperature T is higher than the reference temperature Tw (NO at Step S12), the soak processing is not performed after the cover processing (Step S15), and the nozzle face 111 is put into a state in which it is not soaked by the cleaning liquid 92. The cover processing (Step S15), which puts the nozzle face 111 into the state in which it is not soaked by the cleaning liquid 92, is an example of first cap processing. In the determination processing (Step S12), in a case where the CPU 40 has determined, based on the input value from the temperature detector 23, that the head temperature T is higher than the reference temperature Tw (YES at Step S12), the CPU 40 performs the cover processing (Step S14). The CPU 40 then performs the soak processing (Step S16), which supplies the cleaning liquid 92 to the cap 67 through the supply flow paths 711, 712, thus putting the nozzle face 111 into the state in which it is soaked by the cleaning liquid 92. The soak processing (Step S16) is an example of second cap processing.

In the embodiment that is described above, in a case where the head temperature T that the temperature detector 23 detects is higher than the reference temperature Tw (YES at Step S12), the CPU 40 performs the soak processing (Step S16) to put the nozzle face 111 into the soak state. Therefore, the cleaning liquid 92 draws heat away from the nozzle face 111, promoting the cooling of the head 110. That, in turn, reduces the possibility that an increase in the viscosity of the ink 91 inside the nozzles 112, due to drying, will cause a discharge failure to occur in the nozzles 112 the next time printing is performed. This reduces concern that the nozzles 112 will dry out. Furthermore, even if the ink 91 or the like hardens on the nozzle face 111, it is dissolved by the cleaning liquid 92.

After the cover processing (Step S14), the cap 67 is in the covering state, in which it covers the nozzles 112. With the cap 67 in the covering state, the CPU 40 determines whether it has received the print command (Step S22). In the print processing, it is necessary for the covering of the nozzles 112 by the cap 67 to be released, so the print command is an example of a covering state release command. In a case where the CPU 40 has determined that it has received the print command (YES at Step S22), the CPU 40 performs the print processing (Step S24). In the print processing (Step S24), the CPU 40 first determines whether the nozzle face 111 is in the soak state (Step S240 in FIG. 10). The determination processing at Step S240 is an example of second determination processing. In a case where the soak flag is stored in the EEPROM 44, the CPU 40 determines that the nozzle face 111 is in the soak state (YES at Step S240) and performs the first discharge processing (Step S242). Next, the CPU 40 performs the cover release processing (Step S244).

Therefore, in a case where the CPU 40 has received the print command (YES at Step S22), which is a command to release the covering state, if the CPU 40 determines, in the determination processing at Step S240, that the nozzle face 111 is in the soak state (YES at Step S240), the CPU 40 performs the first discharge processing (Step S242). Therefore, the processing that discharges the cleaning liquid 92 is performed. It is therefore possible to prevent the cover release processing from being performed while the cleaning liquid 92 is inside the cap 67.

After the cover release processing (Step S244), the CPU 40 performs the wipe processing (Step S245), in which the cleaning liquid 92 that is adhering to the nozzle face 111 is wiped away by the wiper 31. Therefore, the cleaning liquid 92 that is adhering to the nozzle face 111 can be wiped away by the wipe processing (Step S245) that follows the cover release processing (Step S244). The adhesion of the cleaning liquid 92 to the nozzle face 111 can therefore be reduced, and the meniscus can be formed.

After the wipe processing (Step S245), the CPU 40 performs the second flushing processing (Step S246), which performs the second flushing. The second flushing processing (Step S246) is an example of flushing processing. Therefore, the cleaning liquid 92 that has entered the nozzles 112 during one of the wipe processing (Step S245) and the soak processing (Step S16) can be discharged by the second flushing processing (Step S246).

In the determination processing at Step S240, in a case where the CPU 40 does not determine that the nozzle face 111 is in the soak state (NO at Step S240), the CPU 40 performs the cover release processing (Step S248), then performs the first flushing processing (Step S250), which performs the first flushing that discharges the first amount of the ink 91. In the second determination processing, in a case where the CPU 40 has determined that the nozzle face 111 is in the soak state (YES at Step S240), the CPU 40 performs the first discharge processing (Step S242 in FIG. 10). The CPU 40 then performs the second flushing processing (Step S246), which performs the second flushing that discharges the second amount of the ink 91, which is greater than the first amount. When the nozzle face 111 is in the soak state, there is a possibility that the cleaning liquid 92 will penetrate into the interiors of the nozzles 112. Therefore, the discharging of the second amount of the ink 91 by the second flushing, which is greater than the first amount of the ink 91 in the first flushing, when the nozzle face 111 is not in the soak state, makes it possible to discharge more thoroughly the cleaning liquid 92 that has penetrated into the interiors of the nozzles 112.

In the determination processing at Step S21, the CPU 40 determines whether the elapsed time H since the covering state of the cap 67 was established by the cover processing (Step S14) is greater than the specified time N. The determination processing at Step S21 is an example of third determination processing. In the determination processing at Step S21, in a case where the CPU 40 has determined that the elapsed time H is greater than the specified time N (YES at Step S21), the CPU 40 performs the first discharge processing (Step S23), which discharges the cleaning liquid 92 inside the cap 67 through the waste liquid flow paths 761, 762, 763. The first discharge processing is an example of discharge processing. If the state in which the cleaning liquid 92 has filled the cap 67 continues for longer than the specified time N, the cleaning liquid 92 may penetrate beyond the nozzles 112, and cases may occur in which the cleaning liquid 92 cannot be completely discharged from the nozzles 112 by maintenance processing such as the flushing processing or the like. Therefore, in the determination processing at Step S21, in a case where the CPU 40 has determined that the elapsed time H is greater than the specified time N (YES at Step S21), the CPU 40 uses the processing at Step S23 to perform the discharge processing of the cleaning liquid 92. The possibility that the cleaning liquid 92 cannot be completely discharged from the nozzles 112 is thus reduced.

With the cap 67 in the covering state that was established by the cover processing (Step S14), the CPU 40 performs the first discharge processing (Step S242), after which it performs the second discharge processing (Step S243). Therefore, the discharge processing is performed for the cleaning liquid 92 with the cap 67 in the covering state, so the covering state is maintained, even after the cleaning liquid 92 has been discharged from the cap 67, and the nozzles 112 can be prevented from drying out. Furthermore, in the second discharge processing, the suction pump 708 is used to suck the cleaning liquid 92 and the air from the inside of the cap 67 while the cap 67 is in the state in which it has moved an short distance away from the nozzle face 111, making it possible to decrease the amount of the cleaning liquid 92 that adheres to the nozzle face 111.

With the nozzle face 111 in the soak state, the CPU 40 uses the determination processing at Step S25 to determine whether it has received the head cleaning command for cleaning the head 110. The determination processing at Step S25 is an example of fourth determination processing. In the determination processing at Step S25, in a case where the CPU 40 has determined that it has received the head cleaning command (YES at Step S25), the CPU 40 performs the soak time head cleaning processing (Step S26). In the soak time head cleaning processing (Step S26), the CPU 40 drains off the cleaning liquid 92 while the cap 67 is in the covering state (Step S261) and performs at least one of the ink suction (Step S262), which sucks the ink 91 out of the nozzles 112, the wipe processing (Step S264), and the first flushing processing (Step S265). Next, the CPU 40 performs the cover processing (Step S266) and the soak processing (Step S267). Therefore, in the determination processing at Step S25, in a case where the CPU 40 has determined that it has received the head cleaning command (YES at Step S25), the CPU 40 performs the drains off the cleaning liquid 92 while the cap 67 is in the covering state and performs at least one of the ink suction, the wipe processing, and the first flushing processing. The head 110 is therefore cleaned. Next, the nozzle face 111 is put into the soak state, in which it is soaked by the cleaning liquid 92, so the nozzles 112 can be prevented from drying out.

In the interval between the completion of print processing (Steps S18, S24, S28) that performs the printing on the printing medium and the moving of the head 110 to the maintenance position, where it is positioned opposite the cap 67, or in the state in which the head 110 to the maintenance position, the CPU 40 performs the determination processing at Step S12. Therefore, if the CPU 40 performs the determination processing at Step S12 in the period up to the moving of the head 110 to the maintenance position, it can perform the cover processing for the cap 67 promptly.

The present invention is not limited to its form in the embodiment that is described above, and various types of modifications can be made. For example, the reference temperature Tw is not limited to 45 degrees Celsius, and the temperature of the head 110 that has been increased by the printing operation, such as 50 degrees Celsius or the like, may be set as the reference. The determination processing at Step S12 may also determine, based on the input value from the temperature detector 23, whether the head temperature T is not less than the reference temperature Tw, instead of higher than the reference temperature Tw. The first cap processing is not limited to a case in which the cleaning liquid 92 is not supplied at all to the interior of the cap 67 in the covering state, and the cleaning liquid 92 may also be injected into the interior of the cap 67 to an extent that does not soak the nozzle face 111.

In the first flushing, the first amount of the ink 91 that is discharged from each of the nozzles 112 is not limited to the total amount of the ink 91 that is discharged by five rounds of an operation in which five hundred drops of the ink 91 are discharged. Furthermore, in the second flushing, the second amount of the ink 91 that is discharged from each of the nozzles 112 is not limited to the total amount of the ink 91 that is discharged by fifteen rounds of an operation in which five hundred drops of the ink 91 are discharged. The second amount needs only to be greater than the first amount and to be an amount that is able to discharge the cleaning liquid 92 that has penetrated into the interiors of nozzles 112. For example, at Step S204, the first amount of the ink 91 that is discharged from each of the nozzles 112 may be the total amount of the ink 91 that is discharged by three rounds of an operation in which three-hundred-fifty drops of the ink 91 are discharged. And at Step S246, the second amount of the ink 91 that is discharged from each of the nozzles 112 may be the total amount of the ink 91 that is discharged by fifteen rounds of an operation in which five hundred drops of the ink 91 are discharged. Then, at Step S250, the first amount of the ink 91 that is discharged from each of the nozzles 112 may be the total amount of the ink 91 that is discharged by five rounds of an operation in which five hundred drops of the ink 91 are discharged and the ink 91 that is subsequently discharged by twenty-five rounds of an operation in which two hundred drops of the ink 91 are discharged.

After the processing at Step S242, the processing at Step S243 is performed, but it is also acceptable for the processing at Step S243 not to be performed. It is also acceptable for the processing at Step S243 to be performed without the processing at Step S242 having been performed. In other words, the processing at Step S243 may be performed as the first discharge processing. The second discharge processing that is shown at Step S243 may also be performed after Step S261. In that case, the operations of the supply on-off valve 721, the waste liquid on-off valve 771, the air on-off valve 743, and the suction pump 708 are the same as their operations at Steps S242 and S243. The specified time N that is determined by the determination processing at Step S21 is not necessarily limited to 300 seconds. The specified time N needs only to be a time that takes into consideration the length of time that the cleaning liquid 92 that is soaking the nozzle 112 penetrates into the interiors of nozzles 112.

It is also acceptable for the partition wall 673 not to be provided in the cap 67. In that case, the first area 661 and the second area 662 would also cease to exist, so it would be possible to supply the cleaning liquid 92 into the interior of the cap 67 only once, and to remove the cleaning liquid 92 only once. In that case, it would also not be necessary to provide both the first flow path system 701 and second flow path system 702, and a single flow path system would be preferable. The number of the partition walls 673 is also not limited. For example, three of the partition walls 673 may be provided in the cap 67, and they may contact the corresponding boundaries between the plurality of the nozzle arrays 121 to 124.

It is also acceptable not to provide the waste liquid on-off valves 771, 772. It is also acceptable not to provide the waste liquid tank 706. The ink 91 that is discharged from the nozzles 112 may also be a discharge agent that decolorizes a dyed cloth, for example.

The opposite end of the gas flow path 733 from the cap 67 is open to the atmosphere, but it may also be connected to a tank that stores a gas other than air, for example. A gas flow path may also be connected to each one of the supply flow paths 711, 712, and an air on-off valve may be provided in each one of the gas flow paths.

The individual steps in the maintenance processing in FIG. 8, the head cleaning processing in FIG. 9, the print processing in FIG. 10, and the soak time head cleaning processing in FIG. 11 are not limited to being performed by the CPU 40, and one of all and a part of the steps may also be performed by another electronic device (for example, an application specific integrated circuit (ASIC)). The individual steps in the processing that is described above may also be performed by distributed processing among a plurality of electronic devices (for example, a plurality of CPUs). Individual steps in the processing in the embodiment that is described above can also be resequenced, omitted, and added as necessary. One of all and a part of the actual processing that is performed by an operating system (OS) that the printer 1 is running based on commands from a CPU with which the printer 1 is provided is included within the scope of the present invention, even in a case where the functions of the embodiment that is described above are implemented by that processing.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head provided with a nozzle face having a nozzle;

a cap configured to contact the nozzle face and covering the nozzle;

a supply flow path connected to the cap and configured to supply a cleaning liquid to the interior of the cap;

a waste liquid flow path connected to the cap and configured to drain off the cleaning liquid that has been supplied to the interior of the cap;

a temperature detector configured to detect the temperature of the head;

a processor; and a memory storing computer-readable instructions that, when executed by the processor, cause the processor to:

perform cover processing that puts the cap into a covering state in which the cap covers the nozzle, perform first determination processing that determines, based on an input value from the temperature detector, whether the temperature is higher than a reference temperature, perform first cap processing that, after the cover processing, puts the nozzle face into a state in which the nozzle face is not soaked by the cleaning liquid when the first determination processing has not determined that the temperature is higher than the reference temperature, and perform second cap processing that, after the cover processing, supplies the cleaning liquid from the supply flow path to the cap, thus putting the nozzle face into a soak state in which the nozzle face is soaked by the cleaning liquid when the first determination processing has determined that the temperature is higher than the reference temperature.

2. The print device according to claim 1, wherein the memory further stores computer-readable instructions, when executed by the processor, cause the processor to:

perform second determination processing that determines whether the nozzle face is in the soak state when the processor receives a command to release the covering state in the covering state, perform first discharge processing that discharges the cleaning liquid inside the cap into the waste liquid flow path when it has been determined by the second determination processing that the nozzle face is in the soak state, and perform cover release processing that releases the cap from the covering state after the first discharge processing.

3. The print device according to claim 2, further comprising:

a wiper configured to contact the nozzle face, wherein the memory further stores computer-readable instructions, when executed by the processor, cause the processor to:

perform wipe processing that uses the wiper to wipe away the cleaning liquid that has adhered to the nozzle face after the cover release processing.

4. The print device according to claim 3, wherein the memory further stores computer-readable instructions, when executed by the processor, cause the processor to:

perform flushing processing that performs flushing after the wipe processing.

5. The print device according to claim 4, wherein the memory further stores computer-readable instructions, when executed by the processor, cause the processor to:

perform first flushing processing that, after the cover release processing, performs first flushing that discharges a first amount of ink from the nozzle when it has not been determined by the second determination processing that the nozzle face is in the soak state, and perform second flushing processing that, after the first discharge processing, performs second flushing that discharges a second amount of the ink from the nozzle, the second amount being greater than the first amount when it has been determined by the second determination processing that the nozzle face is in the soak state.

6. The print device according to claim 5, wherein the memory further stores computer-readable instructions, when executed by the processor, cause the processor to:

perform fourth determination processing that, in the soak state, determines whether the processor has received a command to perform head cleaning that cleans the head, perform head cleaning processing that, in the covering state, drains off the cleaning liquid and performs at least one of purge processing that performs ink suction to suck the ink out of the nozzle, the wipe processing, and the first flushing processing when it has been determined by the fourth determination processing that the processor has received the command to perform head cleaning, and perform the second cap processing after the head cleaning processing.

7. The print device according to claim 1, wherein the memory further stores computer-readable instructions, when executed by the processor, cause the processor to:

perform third determination processing that determines whether a specified time has elapsed since the cap was put into the covering state, and perform the first discharge processing that discharges the cleaning liquid inside the cap into the waste liquid flow path when it has been determined by the third determination processing that the specified time has elapsed.

8. The print device according to claim 1, wherein the memory further stores computer-readable instructions, when executed by the processor, cause the processor to:

perform the first discharge processing that, in the covering state, discharges the cleaning liquid inside the cap into the waste liquid flow path, and perform second discharge processing that, after the first discharge processing, with the cap in a state in which the cap has moved away from the nozzle face, discharges the cleaning liquid inside the cap into the waste liquid flow path.

9. The print device according to claim 8, wherein the memory further stores computer-readable instructions, when executed by the processor, cause the processor to:

perform second discharge processing that, after the first discharge processing, with the cap in a state in which the cap has moved away from a short distance the nozzle face, discharges the cleaning liquid inside the cap into the waste liquid flow path.

10. The print device according to claim 1, wherein the memory further stores computer-readable instructions, when executed by the processor, cause the processor to:

perform the first determination processing performed one of between print processing that prints an image on a printing medium and moving of the head to a maintenance position opposite the cap, and in a state in which the head has moved to the maintenance position.

11. A non-transitory computer-readable medium storing computer-readable instructions that are executed by a processor of a print device provided with a head provided with a nozzle face having a nozzle, a cap configured to contact the nozzle face and covering the nozzle, a supply flow path connected to the cap and configured to supply a cleaning liquid to the interior of the cap, a waste liquid flow path connected to the cap and configured to drain off the cleaning liquid that has been supplied to the interior of the cap, and a temperature detector configured to detect the temperature of the head, the processor being configured to control the print device, and the computer-readable instructions, when executed by the processor, cause the processor to:

perform cover processing that puts the cap into a covering state in which the cap covers the nozzle, perform first determination processing that determines, based on an input value from the temperature detector, whether the temperature is higher than a reference temperature, perform first cap processing that, after the cover processing, puts the nozzle face into a state in which the nozzle face is not soaked by the cleaning liquid when the first determination processing has not determined that the temperature is higher than the reference temperature, and perform second cap processing that, after the cover processing, supplies the cleaning liquid from the supply flow path to the cap, thus putting the nozzle face into a soak state in which the nozzle face is soaked by the cleaning liquid when the first determination processing has determined that the temperature is higher than the reference temperature.

* * * * *